US005701559A

United States Patent [19]

Ootaka et al.

[11] Patent Number: 5,701,559

[45] Date of Patent: Dec. 23, 1997

[54] CLEANERLESS IMAGE FORMING APPARATUS USING AN ELECTROPHOTOGRAPHIC PROCESS

[75] Inventors: Yoshimitsu Ootaka, Shizuoka-ken; Tomoyuki Kato, Mishima; Katsutoshi Sato, Shizuoka-ken, all of Japan

[73] Assignee: Kabushiki Kaisha TEC, Shizuoka, Japan

[21] Appl. No.: 708,700

[22] Filed: Sep. 5, 1996

[30] Foreign Application Priority Data

Sep. 13, 1995 [JP] Japan ..... 7-235751

[51] Int. Cl.[6] ..... G03G 15/30

[52] U.S. Cl. ..... 399/149

[58] Field of Search ..... 399/149, 150, 399/350, 354, 357, 347

[56] References Cited

U.S. PATENT DOCUMENTS

| | | | |
|---|---|---|---|
| 3,617,123 | 11/1971 | Emerson | 399/150 |
| 4,769,676 | 9/1988 | Mukai et al. | 399/150 |
| 5,066,982 | 11/1991 | Hosoya et al. | 399/150 |

FOREIGN PATENT DOCUMENTS

| | | |
|---|---|---|
| 59-111673 | 6/1984 | Japan . |
| 63-129380 | 6/1988 | Japan . |
| 64-36867 | 3/1989 | Japan . |
| 1-295289 | 11/1989 | Japan . |
| 3-127086 | 5/1991 | Japan . |

*Primary Examiner*—S. Lee

*Attorney, Agent, or Firm*—Frishauf, Holtz, Goodman, Langer & Chick

[57] ABSTRACT

An image forming apparatus includes a photosensitive member, a charging device for charging the surface of the photosensitive member at a constant potential, a light beam for exposing the photosensitive member charged by the charging device to form an electrostatic latent image, a developing device for developing the electrostatic latent image by selectively sticking toner to the surface of the photosensitive member so as to correspond to the electrostatic latent image formed by the light beam, and a transfer device for transferring to recording paper the toner image formed by the developing device on the surface of the photosensitive member. The image forming apparatus is applied to a cleanerless system in which the developing device develops the toner image and simultaneously sucks and recovers residual toner remaining on the surface of the photosensitive member after transfer. The image forming apparatus further includes a scraping device that is pressed against the surface of the photosensitive member and scrapes the surface of the photosensitive member, while allowing the residual toner to pass through.

23 Claims, 14 Drawing Sheets

| CONTACT DEPTH OF SCRAPING BLADE TO PHOTOSENSITIVE MEMBER (mm) (CONTACT ANGLE 30°) | AMOUNT OF WEAR OF PHOTOSENSITIVE MEMBER (AFTER 10,000 SHEETS OF PAPER HAVE BEEN PRINTED) (μm) | | DESCRITION OF PASSAGE & REMOVAL | |
|---|---|---|---|---|
| | | CONTACT DEPTH | PASSAGE | REMOVAL |
| 0.1 - LESS THAN 0.3 | 2.0 | (0.2mm) | TONER. PAPER POWDER | HARMFUL DEPOSITS DEGRADED LAYER |
| 0.3 - LESS THAN 0.5 | 3.0 | (0.4mm) | TONER | PAPER POWDER HARMFUL DEPOSITS DEGRADED LAYER |
| 0.5 - LESS THAN 1.0 | 6.0 | (1.0mm) | | TONER. PAPER POWDER HARMFUL DEPOSITS DEGRADED LAYER |
| 1.0 ~ | 10.0 | (1.5mm) | | TONER. PAPER POWDER HARMFUL DEPOSITS DEGRADED LAYER |

FIG. 4

| CONTACT DEPTH OF SCRAPING BLADE TO PHOTOSENSITIVE MEMBER (mm) (CONTACT ANGLE 30°) | AMOUNT OF WEAR OF PHOTOSENSITIVE MEMBER (AFTER 10,000 SHEETS OF PAPER HAVE BEEN PRINTED) (μm) | | DESCRITION OF PASSAGE & REMOVAL | |
|---|---|---|---|---|
| | | CONTACT DEPTH | PASSAGE | REMOVAL |
| 0.1~0.2 | 2.0 | (0.2mm) | TONER. PAPER POWDER | HARMFUL DEPOSITS DEGRADED LAYER |
| 0.3~0.6 | 3.0 | (0.4mm) | TONER | PAPER POWDER HARMFUL DEPOSITS DEGRADED LAYER |
| 0.7~1.5 | 6.0 | (1.0mm) | TONER | (A SMALL AMOUNT OF TONER) PAPER POWDER HARMFUL DEPOSITS DEGRADED LAYER |

FIG. 24

CLEANERLESS IMAGE FORMING APPARATUS USING AN ELECTROPHOTOGRAPHIC PROCESS

BACKGROUND OF THE INVENTION

1. Field of the Invention

This invention relates to an image forming apparatus using an electrophotographic process, and more particularly to a cleanerless image forming apparatus that causes a developing device to recover the residual toner remaining on the photosensitive member after transfer without using a cleaning device.

2. Description of the Related Art

An image forming apparatus using an electrophotographic process as shown in FIG. 1 has been proposed. As shown in FIG. 1, the image forming apparatus has a photosensitive member 1 that holds electrostatic latent images, around which the following devices are arranged in the direction in which the photosensitive member 1 rotates. Specifically, the image forming apparatus comprises: a brush charging device 2 that charges the surface of the photosensitive member 1 at a specific potential uniformly; a light beam 3 that exposes the surface of the charged photosensitive member to form an electrostatic latent image; a developing device 5 that forces toner 4 to stick to the electrostatic latent image formed by the light beam 3 to develop the latent image, forming a toner image; a transfer device 7 that transfers the toner image formed by the developing device 5 onto recording paper 6, a transfer material; a cleaning device 8 that causes a cleaning blade 8*a* to scrape off the residual toner 4*a* remaining on the surface of the photosensitive member after the transfer by the transfer device 7; and a destaticizing lamp 9 that destaticizes the surface of the photosensitive member.

With this type of image forming apparatus, the residual toner 4*a* remaining on the surface of the photosensitive member after the transfer has an adverse effect on a subsequent image formation unless the residual toner is removed, so that the cleaning device 8 is used to remove the residual toner 4*a*.

When the cleaning device 8 is applied to, for example, an inorganic photosensitive member whose surface hardness is relatively high, such as a selenium series material or amorphous silicon, it achieves an excellent residual-toner removing function. With the cleaning device 8, however, it is difficult to remove the deposits on the surface of the photosensitive member, such as fine paper powder, precipitates (e.g., talc) from paper, toner deposits, filmed toner, products of discharging, such as products of corona, at the charging device, or the degraded layer where the properties of part of the surface of the photosensitive member deteriorates.

Such deposits, especially paper powder and products of discharging, absorb moisture at high humidity and present low resistance, which seriously disturbs the electrostatic latent image formed on the surface of the photosensitive member, degrading the picture quality.

To avoid these disadvantages, a cleaning device which includes not only a residual toner removal cleaning device but also a deposit removal cleaning brush that removes deposits other than the toner existing on the surface of the photosensitive member has been disclosed in, for example, Jpn. UM Appln. KOKAI Publication No. 64-36867 or Jpn. Pat. Appln. KOKAI Publication No. 1-295289.

Furthermore, Jpn. Pat. Appln. KOKAI Publication No. 59-111673 and Jpn. Pat. Appln. KOKAI Publication No. 63-129380 have disclosed a cleaning device that is used with a residual toner removal cleaning device and forces a grind cleaning roller formed of an elastic material, such as silicone rubber or urethane foam, to scrape the photosensitive member, thereby removing not only the deposits but also the degraded layer at the surface of the photosensitive member by the grinding effect.

The grind cleaning roller, being pressed strongly against the photosensitive member, removes the deposits and the degraded layer. At the same time, however, the strongly pressed contact causes the surface of the photosensitive member to be scraped too much or irregularly, resulting in deterioration of the picture quality. It can also shorten the service life of the photosensitive member.

To overcome these drawbacks, in Jpn. Pat. Appln. KOKAI Publication No. 59-111673, the grind cleaning roller is provided so that it may come into contact with and separate from the surface of the photosensitive member. The grind cleaning roller is pressed against and grinds the surface of the photosensitive member each time, for example, 2000 sheets of paper have been printed out, thereby removing the deposits and the degraded layer, while preventing the surface of the photosensitive member to be overscraped. Since deterioration of the picture quality due to the deposits and the degraded layer results from the accumulation of the deposits and the degraded layer, it has no direct effect on the image formed in subsequent processes, unlike the residual toner. Therefore, the deposits and degraded layer need not be removed successively. An apparatus with a grind cleaning roller that can come into contact and separate from the photosensitive member, requires a cleaning roller separating and contacting mechanism, making the apparatus more complicated and larger.

Organic photosensitive materials have been used widely as photosensitive members. Since organic photosensitive members have a low surface hardness, just the pressure contact of the elastic blade causes the surface of the photosensitive member to be ground sufficiently, removing the deposits and the degraded layer, in the cleaning device, with the result that a grind cleaning roller need not be provided. In the case of organic photosensitive members, however, their photosensitive layer wears seriously even with a residual toner removal cleaning device alone, resulting in deterioration of the picture quality and a shortened life of the photosensitive member due to the overscraping or irregular scraping of the photosensitive member.

In contrast, a cleanerless image forming apparatus that recovers the residual toner by the developing device without using a residual toner removal cleaning device has been disclosed in Jpn. Pat. Appln. KOKAI Publication No. 3-127086. As shown in FIG. 2, around a photosensitive member 1, the image forming apparatus has a brush charging device 2, a light beam 3, a developing device 5, a transfer device 7, a destaticizing lamp 10, and a conductive brush 11 that makes the residual toner uniform.

In an inverted development method using the toner 4 charged in the same polarity as that of the photosensitive member 1, toner particles 4 are forced to stick to the image portion (the portion of the surface of the photosensitive member where no charge exists or where the amount of charges is small) that has been exposed by the light beam 3, whereas no toner 4 is caused to stick to the non-image portion (the portion of the surface of the photosensitive member where the amount of charges is large) that has not been exposed by the light beam 3.

To realize such selective toner adhesion, a voltage of Vb ($|Vr|<|Vb|<|Vo|$) between the potential Vo of the non-image portion at the surface of the photosensitive member and the potential Vr of the image portion is applied to a developing roller 12 of the developing device 5. The electric field between the non-image portion and the developing roller 12 suppresses the adhesion of toner to the photosensitive member 1, whereas the electric field between the image portion and the developing roller 12 causes the toner to adhere to the photosensitive member 1.

The toner 4 stuck to the photosensitive member 1 is transferred to the recording paper 6 by the transfer device 7. After the transfer, the residual toner 4*a* remaining on the surface of the photosensitive member 1 without being transferred to the recording paper 6 distributes itself in the image portion.

After destaticization by the destaticizing lamp 10, when the residual toner 4*a* distributed in the image portion on the photosensitive member 1 passes under the conductive brush 11, the residual toner 4*a* is sucked by the conductive brush 11 by setting the electric field formed by the voltage applied to the conductive brush 11, the photosensitive member surface potential, and the residual toner 4*a* at a specific value. Furthermore, by setting the electric field formed by the voltage applied to the conductive brush 11, the photosensitive member surface potential, and the residual toner 4*a* at the specific value, the residual toner 4*a* on the conductive brush 11 are released by electrostatic force into the non-image portion on the photosensitive member 1 or a portion where the photosensitive member 1 is not in contact with the recording paper 6. As described above, control of the voltage applied to the conductive brush 11 disturbs the distribution of the residual toner 4*a*, making it possible to distribute the residual toner 4*a* uniformly all over the photosensitive member 1.

The residual toner thus uniformed distributes itself almost in isolation, not in a lump, so that it does not disturb the charging action in the charging process in the brush charging device 2, which enables the photosensitive member 1 to be charged uniformly. At this time, the residual toner 4*a* is also charged in the same polarity as that of the photosensitive member 1. In addition, in exposure by the light beam 3, the residual toner 4*a* remaining on the photosensitive member 1 does not shade the light beam 3, so that the effect of the preceding image has no effect on the formation of an electrostatic latent image in the next stage, preventing a memory phenomenon (what is called a ghost phenomenon) from occurring.

The residual toner 4*a* is recovered again into the developing device 5 at the same time that the electrostatic latent image is developed in the developing process. Specifically, because the residual toner 4*a* existing in the non-image portion of the latent image formed by the exposure of the light beam 3 is charged by the charging device 2 in the same polarity as that of the photosensitive member 1, the electric field (i.e., the electric field caused by the potential difference between Vo and Vb) that tends to transfer the residual toner from the photosensitive member 1 to the developing roller 12 side, causes the residual toner 4*a* to transfer to the developing roller 12 side. That is, the photosensitive member undergoes cleaning.

At the same time, the residual toner 4*a* remaining in the image portion receives the force going from the developing roller 12 toward the photosensitive member 1 and remains on the surface of the photosensitive member 1. Onto the image portion, new toner 4 is transferred further from the developing roller 12. That is, the latent image is developed.

As described above, development and cleaning are carried out simultaneously.

Such a cleanerless image forming apparatus needs no residual toner removal cleaning device, so that the photosensitive member is not scraped by a cleaning device, making smaller the amount of wear of the photosensitive member and lengthening the service life of the organic photosensitive member.

With the cleanerless image forming apparatus, however, since the cleaning device does not scrape the photosensitive member, it is difficult to remove the deposits on the surface of the photosensitive member, such as fine paper powder, the precipitates (e.g., talc) from paper, toner deposits, filmed toner, products of discharging, such as products of corona, or the degraded layer at the surface of the photosensitive member.

As described above, with the cleanerless image forming apparatus, its service life is determined by the accumulation of the deposits and degraded layer at the surface of the photosensitive member rather than by wear of the photosensitive member.

Furthermore, the cleanerless image forming apparatus uses a brush charging device 2 to suppress the generation of ozone, which degrades the photosensitive member. When a negative contact-type charging device 2 is used by using a negatively charged photosensitive member as the photosensitive member 1, the charging device 2 generates almost no ozone. In addition, when a positive corona charger is used as the transfer device 7, the corona charger (the transfer device 7) generates much a smaller amount of ozone than a negative corona charger, reducing the amount of ozone generated on the whole.

Use of the brush charging device 2, however, permits aerial discharge to take place very close to the surface of the photosensitive member, causing a large amount of products of discharging to adhere to the surface of the photosensitive member. Furthermore, hygroscopic material, such as fine paper powder or talc, is liable to stick to the brush charging device 2. Such a material transfers to the surface of the photosensitive member easily.

Then, at high humidity, products of discharging or hygroscopic material absorb moisture, adhere firmly to the surface of the photosensitive member, and present low resistance. As a result, this disturbs the electrostatic latent image seriously, resulting in defective images, such as image drift or a white missing portion in the image.

SUMMARY OF THE INVENTION

Accordingly, the object of the present invention is to provide an image forming apparatus capable of preventing the picture quality from deteriorating.

The foregoing object is accomplished by providing an image forming apparatus comprising: an image holding member; a charging device for charging the surface of the image holding member at a constant potential; an exposing device for exposing the image holding member charged by the charging device to form an electrostatic latent image; a developing device for developing the electrostatic latent image by selectively sticking toner to the surface of the image holding member so as to form a toner image corresponding to the electrostatic latent image formed by the exposing device; and a transfer device for transferring to a transfer material the toner image formed by the developing device on the surface of the image holding member, wherein the developing device develops the toner image and simultaneously sucks and recovers residual toner remaining on the surface of the image holding member after transfer, and wherein the image forming apparatus further comprises a scraping device that is pressed against the surface of the image holding member and scrapes the surface of the image holding member, while allowing the residual toner to pass through.

With the image forming apparatus, the scraping device that scrapes the surface of the image holding member not only removes the deposits except for the residual toner from the image holding member but also allows the residual toner to pass through toward the developing device. This makes it possible to recover the residual toner reliably into the developing device without making the residual toner waste toner.

Furthermore, with the image forming apparatus, when the residual toner passes through the scraping device, it is rotated on the surface of the image holding member. The friction caused by the rotation enables the surface of the image holding member to be worn suitably. This not only prevents the accumulation of deposits on the surface of the image holding member but also removes the degraded layer where the properties of the surface of the image holding member have deteriorated. As a result, it is possible to prevent not only defects in the electrostatic latent image formed on the image holding member but also the deterioration of the picture quality of the toner image transferred to the transfer material.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 4 shows the results of experiments conducted to determine the optimum contact depth of an elastic blade applied to the first embodiment with respect to the photosensitive member;

FIG. 24 shows the results of experiments conducted to determine the optimum contact depth of the elastic blade of FIG. 3 with respect to the photosensitive member, when spherical toner is used.

DETAILED DESCRIPTION OF THE PREFERRED EMBODIMENTS

Hereinafter, referring to the accompanying drawings, embodiments of the present invention will be explained.

Figure 3:
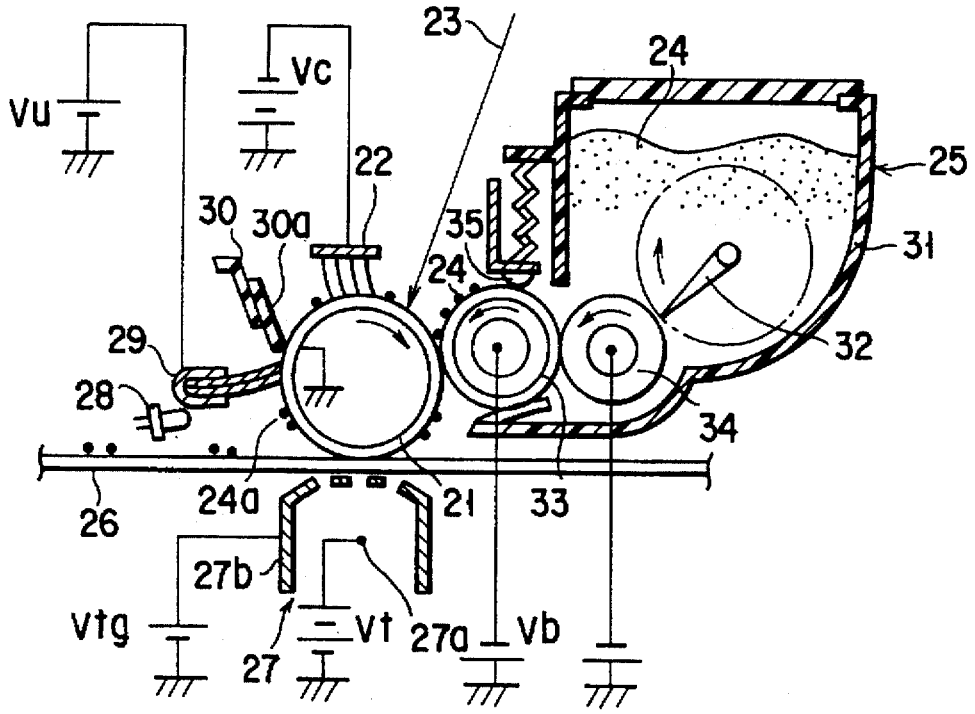
FIG. 3 shows a rough configuration of a cleanerless image forming apparatus according to a first embodiment of the present invention.

First, an image forming apparatus according to a first embodiment of the present invention will be described. P As shown in FIG. 3, the image forming apparatus has a photosensitive member 21 acting as an image holding member, around which the devices explained below are arranged in order.

Specifically, the image forming apparatus comprises: a contact-type charging device 22 which includes a conductive brush that charges the surface of the photosensitive member uniformly at a constant charging potential; a generator section (not shown) for a light beam 23 that exposes the surface of the photosensitive member 21 charged by the charging device 22 and forms an electrostatic latent image; and a developing device 25 that develops the electrostatic latent image formed by the light beam 23 by forcing toner to stick to the electrostatic latent image and thereby forms a toner image. The image forming apparatus further comprises: a transfer device 27 that transfers the toner image formed by the developing device 25 onto recording paper 26 acting as a transfer material; a destaticizing lamp 28 that destaticizes the surface of the photosensitive member after the transfer at the transfer device 27; an equalizing device 29 with a conductive brush that levels and equalizes the image of the residual toner 24*a* remaining on the surface of the photosensitive member after the transfer at the transfer device 27; and a scraping device 30 that not only allows the residual toner 24*a* to pass through but also separates the deposits except for the toner from the surface of the photosensitive member.

A charging voltage Vc is applied to the charging device 22 and an equalizing voltage Vu is applied to the equalizing device 29.

The developing device 25 comprises: a toner reservoir section 31 that reserves toner 24, a stirrer 32 that stirs the toner 24 in the toner reservoir section 31; an elastic developing roller 33 that has a conductive layer at the surface and is applied with a developing voltage Vb; a supply roller 34 that supplies the toner 24 in the toner reservoir section 31 to the developing roller 33; and a toner layer thickness limiting member 35 that forms the toner 24 supplied to the developing roller 33 into a uniform toner layer.

The transfer device 27 includes a transfer corona wire 27*a* to which a transfer corona voltage Vt is applied and a shield case 27*b* with a transfer grid to which a transfer grid voltage Vtg is applied.

The generator section for the light beam 23 includes, for example, a laser oscillator, a laser scanning optical system, etc.

The scraping device 30 has an elastic blade 30*a* with an edge section. When being brought into contact with the surface of the photosensitive member 21 at a specific pressure, the edge section of the elastic blade 30*a* removes the products of discharging harmful to image formation on the surface of the photosensitive member, toner deposits, paper powder, precipitates from paper and toner, the degraded layer at which the surface properties of the photosensitive member have changed, etc., and thereby refreshes the surface of the photosensitive member.

Figure 1:
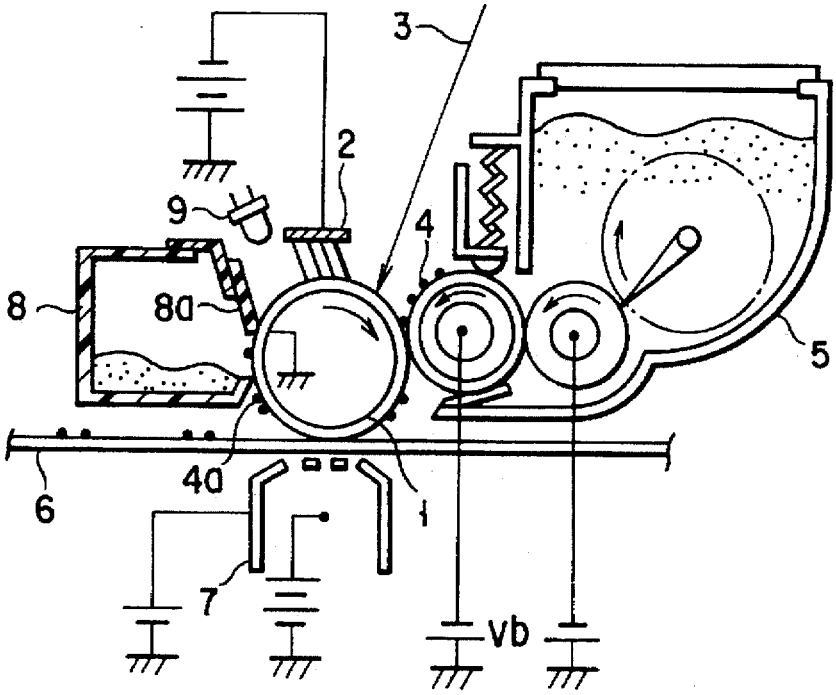
FIG. 1 (PRIOR ART)
FIG. 1 shows a rough configuration of an image forming apparatus with a conventional residual toner removal cleaning device.
Figure 2:
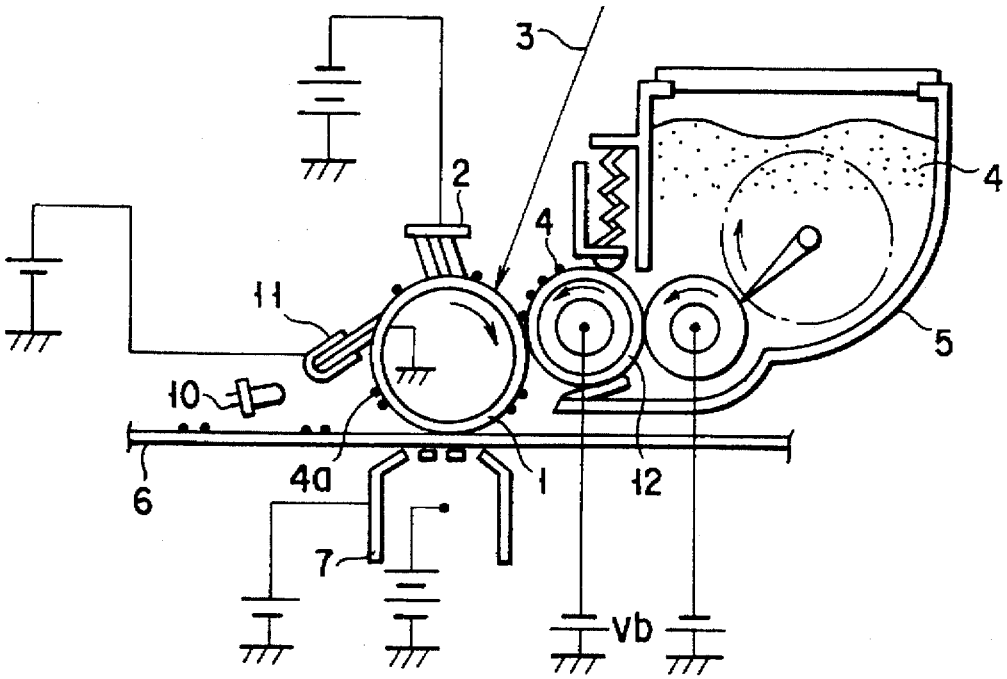
FIG. 2 (PRIOR ART)
FIG. 2 shows a rough configuration of a conventional cleanerless image forming apparatus.

Like the cleanerless image forming apparatus of FIG. 2, the image forming apparatus thus constructed forms an image by an inverted development method. Specifically, the toner 24 charged in the same polarity as that of the photosensitive member 21 is used. The toner particles 24 are forced to stick to the image portion (the portion of the surface of the photosensitive member where no charge exists or where the amount of charges is small) that has been exposed by the light beam 23, whereas no toner 24 is caused to stick to the non-image portion (the portion of the surface of the photosensitive member where the amount of charges is large) that has not been exposed by the light beam 23. To realize such selective toner adhesion, a voltage of Vb ($|Vr|<|Vb|<|Vo|$) between the potential Vo of the non-image portion at the surface of the photosensitive member and the potential Vr of the image portion is applied to the developing roller 33 of the developing device 25. The electric field between the non-image portion and the developing roller 33 suppresses the adhesion of toner to the photosensitive member 21, whereas the electric field between the image portion and the developing roller 33 causes the toner to adhere to the photosensitive member 21.

The toner 24 stuck to the photosensitive member 21 is transferred to the recording paper 26 by the transfer device 27. In the transfer process, all of the toner is not transferred. The residual toner 24*a* is distributed in the image portion on the surface of the photosensitive member 21 after the transfer.

After destaticization by the destaticizing lamp 28, when the residual toner 24*a* distributed in the image portion on the photosensitive member 21 passes under the equalizing device 29, the residual toner 24*a* is sucked by the equalizing device 29, with the electric field formed by the voltage Vu applied to the equalizing device 29, the photosensitive member surface potential, and the residual toner 24*a* being set at a specific value. Furthermore, by setting the electric field formed by the voltage Vu applied to the equalizing device 29, the photosensitive member surface potential, and the residual toner 24*a* at the specific value, the residual toner 24*a* on the equalizing device 29 is released by electrostatic force into the non-image portion on the photosensitive member 21 or a portion where the photosensitive member 21 is not in contact with the recording paper 26.

As described above, control of the voltage applied to the equalizing device 29 disturbs the distribution of the residual toner 24*a*, making it possible to distribute the residual toner 24*a* uniformly over the photosensitive member 21.

The residual toner thus uniformly distributes itself almost in isolation, not in a lump, so that it does not disturb the charging action by the brush charging device 22, which enables the photosensitive member 21 to be charged uniformly. At this time, the residual toner 24*a* is also charged in the same polarity as that of the photosensitive member 21.

In addition, in exposure by the light beam 23, the residual toner 24*a* remaining on the preceding image shape does not shade the light beam 23, so that the effect of the preceding image has no effect on the formation of an electrostatic latent image in the next stage, preventing a memory phenomenon (what is called a ghost phenomenon) from occurring.

The residual toner 24*a* is recovered again into the developing device 25 at the same time that the electrostatic latent image is developed in the developing process. Specifically, because the residual toner 24*a* existing in the non-image portion of the latent image formed by the exposure of the light beam 23 is charged by the charging device 22 in the same polarity as that of the photosensitive member 21, the electric field (i.e., the electric field caused by the potential difference between Vo and Vb) that tends to transfer the negatively charged toner from the photosensitive member 21 to the developing roller 33, causes the residual toner 4*a* to transfer to the developing roller 33 side. That is, the photosensitive member undergoes cleaning.

At the same time, the residual toner 24*a* remaining in the image portion of the electrostatic latent image receives the force going from the developing roller 33 toward the photosensitive member 21 and remains on the surface of the photosensitive member 21. Onto the image portion, new toner 24 is transferred further from the developing roller 33. That is, the latent image is developed. As described above, development and cleaning are carried out simultaneously.

In the image forming process, the scraping device 30 removes the products of discharging harmful to image formation on the surface of the photosensitive member, toner deposits, paper powder, precipitates from paper and toner, the degraded layer at the surface of the photosensitive member, and thereby refreshes the surface of the photosensitive member. In that case, selective cleaning is effected in such a manner that the residual toner 24*a* is allowed to pass through but the products of discharging harmful to image formation and the degraded layer are scraped and removed. The condition for the selective cleaning is related to the contact depth of the edge section of the elastic blade 30*a* of the scrape device 30 with respect to the photosensitive member 21. The contact depth is the hypothetical distance from the position of the intended point P at which the elastic blade 30*a* of the scraping device is located without warping along the surface of the photosensitive member 21 to the surface of the photosensitive member. The results of experiments showed the relationship between the contact depth, the passage or removal of the residual toner 24*a*, harmful deposits, and degraded layer, and the amount of wear of the photosensitive member 21 in FIG. 4.

The deposits and degraded layer in the experiments were classified into paper powder, the other harmful deposits (products of discharging, toner deposits, and precipitates from paper and toner), and degraded layer (degraded layer at the photosensitive member surface).

Figure 5:
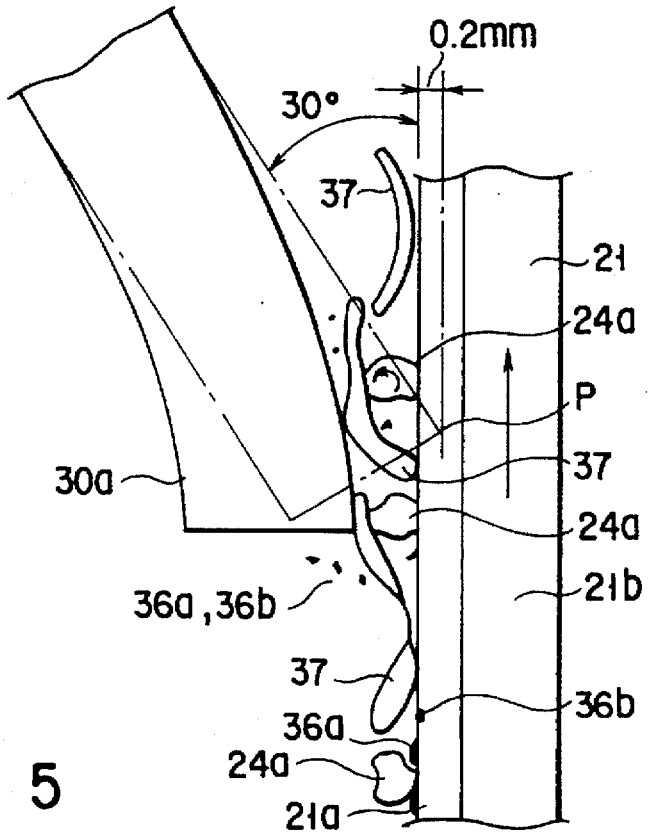
FIG. 5 is a pictorial diagram to help explain the action of the elastic blade applied to the first embodiment with a contact depth of 0.2 mm.
Figure 6:
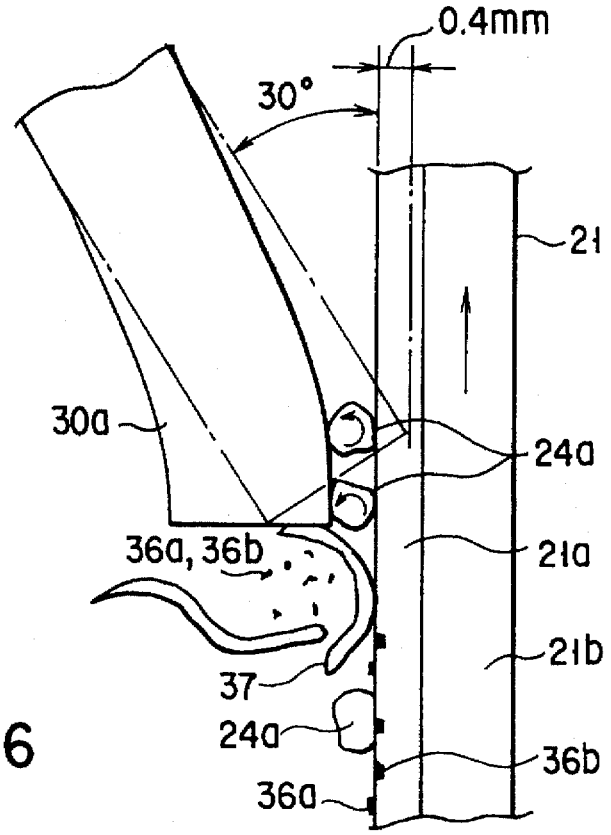
FIG. 6 is a pictorial diagram to help explain the action of the elastic blade applied to the first embodiment with a contact depth of 0.4 mm.
Figure 7:
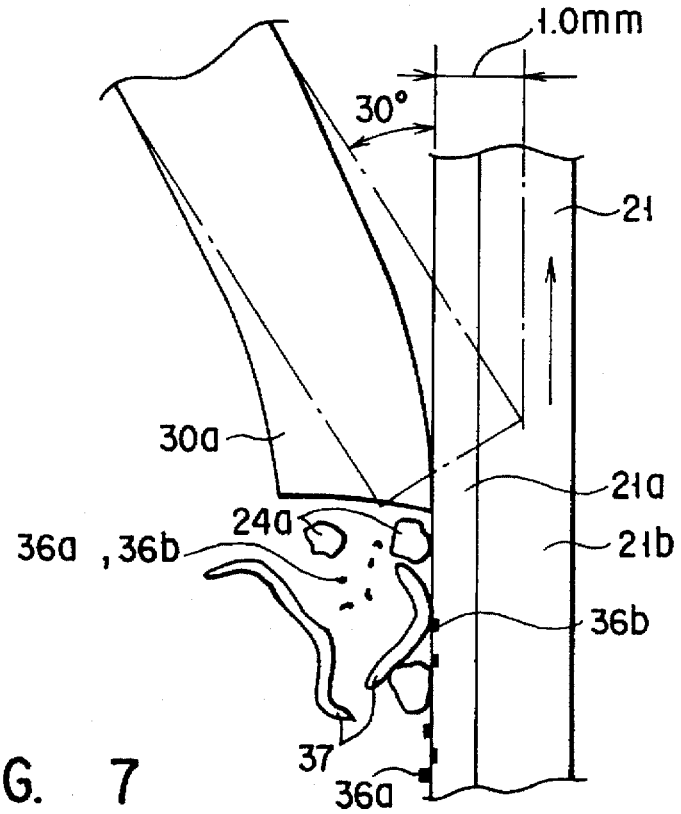
FIG. 7 is a pictorial diagram to help explain the action of the elastic blade applied to the first embodiment with a contact depth of 0.1 mm.

FIGS. 5 to 7 pictorially show the mechanism of the passage and removal of the residual toner 24*a*, harmful deposits, and degraded layer by the elastic blade 30*a* in the experiments. The elastic blade 30*a* used in the experiments was formed of urethane rubber (1.8 mm in thickness, #1265, manufactured by BANDO CHEMICALS Co.). It may be formed of ethylene-propylene-diene terpolymer (EPDM) or silicone rubber. The toner 24 used in the experiments was uni-component non-magnetic negatively charged toner obtained by using as a parent material polyester resin in which carbon, a polarity control agent, wax, etc. are distributed, breaking it into nonspherical particles with an average radius of 10 μm by a grinding method, classifying them, and externally adding fine silica particles.

The photosensitive member 21 uses a two-layer (charge generating layer/charge (carrying layer) negatively charged organic photosensitive layer using phthalocyanine pigment as charge generating material, hydrazone derivative as charge carrying material, polycarbonate as binder resin. The negatively charged organic photosensitive layer 21*a* is applied to a bare metal pipe (bare aluminum pipe) 21*b* to a specified thickness to produce the photosensitive member 21.

FIG. 5 shows a case where the contact angle of the elastic blade 30*a* to the photosensitive member 21 is determined to be 30° and the contact depth is determined to be 0.2 mm. In the figure, the arrow shows the direction in which the photosensitive member 21 moves. Since the harmful deposits 36*a*, including the products of discharging and toner deposits, and the photosensitive member surface degraded layer 36*b* exist very thinly on and at the surface of the photosensitive member layer 21*a*, they can be removed with a contact depth of nearly 0.1 mm or more. With this contact depth, the residual toner 24*a* passes through, while rotating, in such a manner that it slips under the elastic blade 30*a*. The harmful deposits 36*a* and degraded layer 36*b* are also removed by the rolling friction of the residual toner 24*a* to the surface of the photosensitive member layer 21*a*. In contrast, the paper powder 37 slips under the elastic blade 30*a* and passes through.

In FIG. 5, the contact depth was 0.2 mm. The phenomenon was observed with the contact depth ranging from 0.1 mm or more to less than 0.3 mm. In the range, although the harmful deposits 36*a* and degraded layer 36*b* were removed, the paper powder 36 was not removed. The amount of wear of the photosensitive member was 2.0 μm after 10000 sheets of paper had been printed.

FIG. 6 shows a case where the contact angle of the elastic blade 30*a* to the photosensitive member 21 is determined to be 30° and the contact depth is determined to be 0.4 mm. The paper powder 37 keeps stuck by electrostatic force. Since the paper powder 37 has smaller adhesive force than the residual toner 24*a* and is larger in particle size, a contact depth of 0.3 mm or more enables the elastic blade 30*a* to remove the paper powder. With this contact depth, the harmful deposits 36*a*, including the products of discharging and toner deposits, and the degraded layer 36*b* at the photosensitive member surface are also removed. In this case, the residual toner 24*a* passes through, while rotating, in such a manner that it slips under the elastic blade 30*a*. The harmful deposits 36*a* and degraded layer 36*b* are also removed by the rolling friction of the residual toner 24*a* to the surface of the photosensitive member layer 21*a*.

In FIG. 6, the contact depth was 0.4 mm. The phenomenon was observed with the contact depth ranging from 0.3 mm or more to less than 0.5 mm. In the range, not only the harmful deposits 36*a* and degraded layer 36*b* but also the paper powder 37 were removed, enabling the photosensitive member surface to be refreshed by the selective cleaning that permits only the residual toner to pass through. Because only the residual toner 24*a* is allowed to pass through reliably, it is possible to surely recover the residual toner 24*a* with the developing roller 33 of the developing device 25 without throwing away the residual toner as waste toner. The amount of wear of the photosensitive member was 3.0 μm after 10000 sheets of paper had been printed.

FIG. 7 shows a case where the contact angle of the elastic blade 30*a* to the photosensitive member 21 is determined to be 30° and the contact depth is determined to be 1.0 mm. With a contact depth of 0.5 mm or more, the elastic blade 30*a* is always in contact with the surface of the photosensitive member 21, the blade removes not only the harmful deposits 6*a*, degraded layer 36*b*, and paper powder 37 but also the residual toner 24*a*.

In FIG. 7, the contact depth was 1.0 mm. The phenomenon was observed with the contact depth ranging from 0.5 mm or more to less than 1.0 mm. In the range, the harmful deposits 36*a*, degraded layer 36*b*, paper powder 37, and residual toner 24*a* are all removed, with the result that the residual toner 24*a* becomes waste toner, making it impossible to recover the residual toner 24*a*. The amount of wear of the photosensitive member was as large as 6.0 μm after 10000 sheets of paper had been printed.

Furthermore, with the contact depth of the elastic blade 30*a* to the photosensitive member 21 being 1.0 mm or more, the elastic blade functioned in the same manner as the residual toner removal blade used for a conventional cleaning device. In this case, the amount of wear of the photosensitive member reached a very large value of 10.0 μm after 10000 sheets of paper had been printed.

Figure 8:
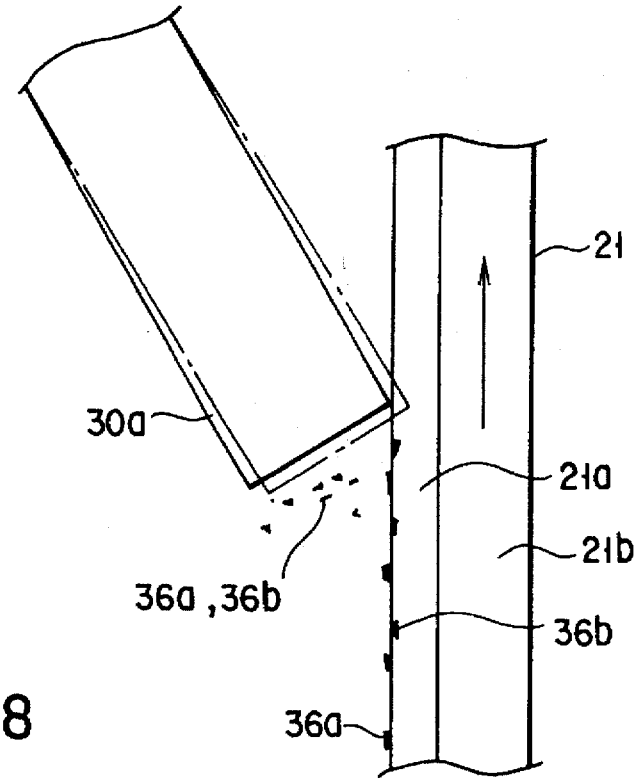
FIG. 8 is a pictorial diagram to help explain the action of the elastic blade applied to the first embodiment with its edge being in direct contact with the photosensitive member.

In a case where the residual toner 24*a* and paper powder 37 hardly exist on the surface of the photosensitive member 21, as shown in FIG. 8, the elastic blade 30*a* comes into contact with the surface of the photosensitive member 21 intermittently and locally and removes the harmful deposits 36*a* and degraded layer 36*b*, thereby refreshing the photosensitive member surface.

Because the results described above differ, depending on the material of the elastic blade 30*a*, and the material and curvature of the photosensitive member 21 and the amount of charges, shape, and particle diameter of the toner 24, the contact depth and contact angle are optimized by experiment.

Unlike the state where the elastic blade 30*a* is always in direct contact with the entire surface, the state where a small amount of toner 24 always exists between the elastic blade 30*a* and the surface of the photosensitive member 21 prevents the photosensitive member surface from wearing excessively. Specifically, the rolling friction of toner particles reduces the frictional force acting on the photosensitive member surface.

In a case where the elastic blade 30*a* is in contact with the entire surface of the photosensitive member at the time when the photosensitive member 21 starts to rotate, since the static friction coefficient of the elastic blade 30*a* is greater than its dynamic friction coefficient, the elastic blade produces larger frictional force than when it is rotating continuously. In this case, the constant existence of a small amount of toner 24 between the elastic blade 30*a* and the surface of the photosensitive member 21 prevents excessive wear at the time when the photosensitive member 21 starts to rotate.

Because the elastic blade 30*a* does not scrape the residual toner 24*a* but allows the residual toner to pass through, the edge section of the elastic blade 30*a* functions properly even if it becomes flat due to wear, with the result that the elastic blade 30*a* can be used for a long time.

Since the scraping device 30 is positioned in the downstream side of the equalizing device 29, the distribution of the residual toner 24*a* is leveled by the equalizing device 29 and made almost uniform in front of the scraping device 30. Consequently, in the scraping device 30, the residual toner 24*a* is allowed to pass through smoothly.

If the scraping device 30 is placed in the upstream side of the equalizing device 29, the scraping device 30, which has a paper powder removing function, prevents paper powder from adhering to the equalizing device 29 as much as possible, thereby preventing the fullness of paper powder from degrading the performance of the equalizing device 29.

Figure 9:
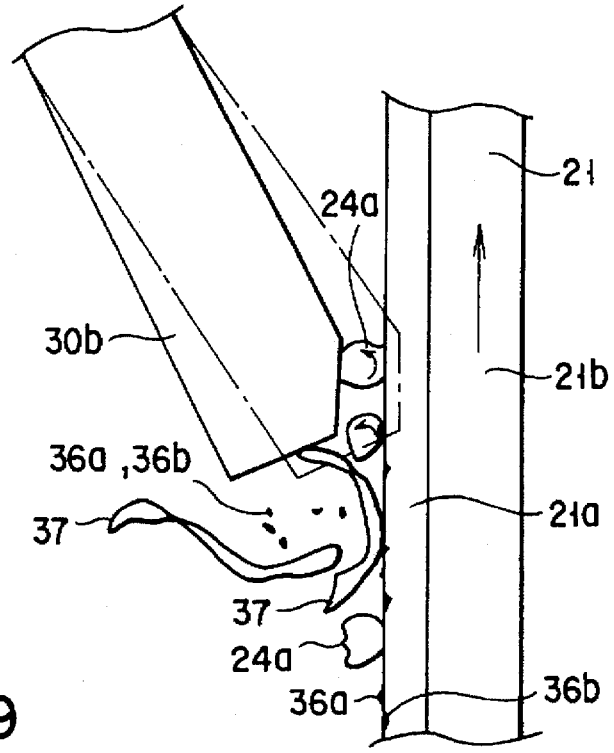
FIG. 9 is a pictorial diagram to help explain the action of a modification of the elastic blade applied to the first embodiment, the modification being an elastic blade with a flat surface portion.

While in the first embodiment, the elastic blade 30*a* with the edge section is used as an elastic blade constituting the scraping device 30 and the edge section of the elastic blade 30*a* is pressed against the surface of the photosensitive member 21, an elastic blade with a flat surface portion may be used and the flat surface portion of the elastic blade 30*b* be pressed against the surface of the photosensitive member 21 as shown in FIG. 9.

Figure 10:
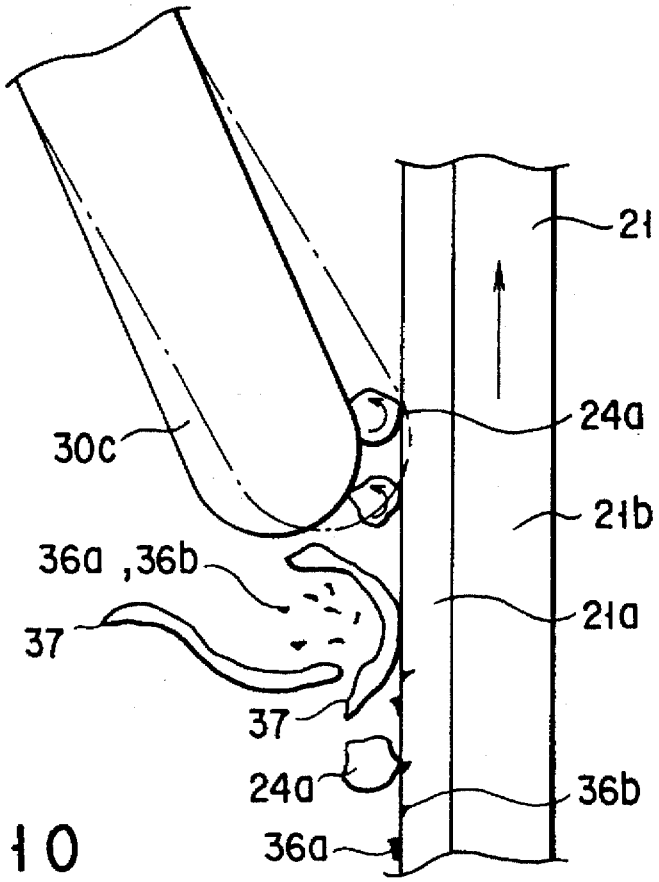
FIG. 10 is a pictorial diagram to help explain the action of a modification of the elastic blade applied to the first embodiment, the modification being an elastic blade with a curved surface portion.

Additionally, as shown in FIG. 10, an elastic blade 30*c* with a curved surface portion may be used and the curved surface portion of the elastic blade 30*c* be pressed against the surface of the photosensitive member 21.

Unlike the elastic blade 30*a* with the edge section, the elastic blade 30*b* with the flat surface portion and the elastic blade 30*c* with the curved surface portion make it easier for the toner particles to slip into between the elastic blade 30*b* (30*c*) and the photosensitive member 21 by the rolling effect produced by the rotation of the residual toner 24*a*, thereby making it easier for the residual toner 24*a* to pass through the elastic blade 30*b* (30*c*). This improves the recovery rate of the residual toner 24*a* at the developing device 25. Additionally, this broadens the effective contact conditions and makes the accuracy of device components and the assembly accuracy less strict, which provides favorable conditions in terms of productivity and manufacturing cost.

Like use of the elastic blade 30*a* with the edge section, use of the elastic blade 30*b* with the flat surface portion or the elastic blade 30*c* with the curved surface portion not only removes the paper powder, harmful deposits, and degraded layer but also allows the residual toner to pass through by selective cleaning reliably, with the contact depth of the blade to the photosensitive member surface being set suitably.

Figure 11:
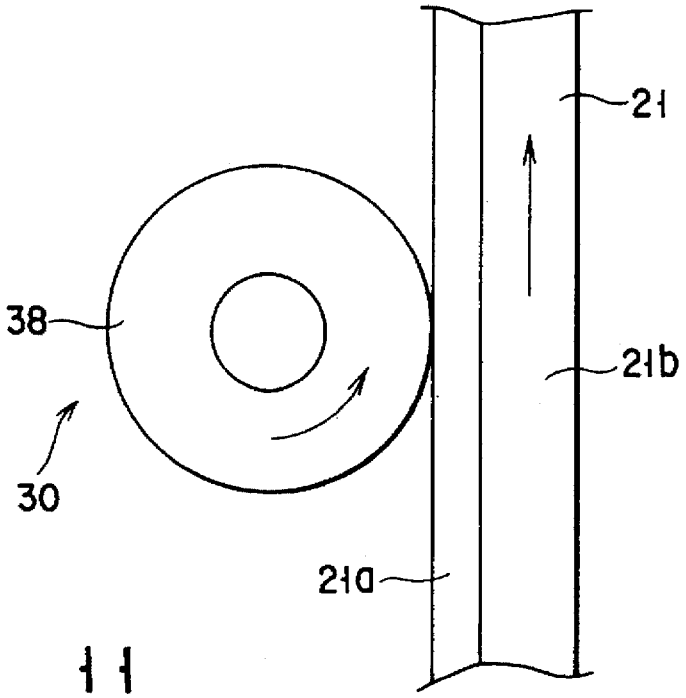
FIG. 11 schematically illustrates the construction of an elastic roller as a modification of a scraping device applied to the first embodiment.

While in the first embodiment, the scraping device 30 with an elastic blade has been explained, the present invention is not limited to this. For instance, the invention may be applied to a scraping device with an elastic roller 38 as shown in FIG. 11. The elastic roller 38 is made of urethane rubber or silicone rubber with the surface of the roller being applied with urethane or Teflon coating. The elastic blade 38 may be impregnated with abrasive.

It is desirable that the depth contact of the roller 38 with the surface of the photosensitive member 21 should be about in the range from 0.5 mm to 3.0 mm. The roller 38 rotates in the same direction as that of the photosensitive member 21 at the contact surface. The direction in which the roller rotates may be opposite. It is favorable that the rotation speed should be about 0.5 to 5.0 times the peripheral speed of the photosensitive member surface. Namely, the rotation speed and direction of rotation of the roller 38 are set so that the roller may scrape the photosensitive member surface suitably.

Use of the roller 38 produces the same effect as the elastic blade 30*c* with the curved surface portion of FIG. 10. In addition, even if the roller 38 has been locally damaged as a result of foreign matter, such as paper powder, getting stuck in the roller, the damaged portion does not adversely affect the entire periphery of the photosensitive member 21, because the damaged portion does not keep in contact with the photosensitive member 21 at all times. Namely, there is no possibility that continuous streaked defects will appear on the image transferred onto the recording paper 26 in the direction in which the recording paper is transported. Since the removal of the harmful deposits and degraded layer and the passage control of the residual toner 24*a* can be performed on the basis of not only the contact depth but also the direction of rotation and the speed of rotation, it is possible to allow a latitude for the setting of scraping conditions, thereby coping with various types of toner and photosensitive member.

As described above, by making use of the difference in adhesive force acting on the photosensitive member surface between harmful substances and of the rolling effect of toner particles by the use of the elastic blade or elastic roller acting as the scraping device under the optimum conditions, selective cleaning is effected which removes the harmful products of discharging on the photosensitive member surface, toner deposits, paper powder, precipitations from paper and toner, and degraded layer at the photosensitive member surface but allows the residual toner 24*a* to pass through. The selective cleaning action and the rolling friction of toner particles enable the photosensitive member surface to be refreshed at a necessary minimum amount of wear of the photosensitive member.

Accordingly, it is possible to realize a cleanerless image forming apparatus that assures a long service life of the photosensitive member 21, provide good images stably for a long time, and produce no waste toner. Furthermore, use of the contact-type charging device 22 not only prevents the products of discharging from sticking to the photosensitive member 21 but also alleviating the generation of ozone.

Next, an image forming apparatus according to a second embodiment of the present invention will be explained.

Figure 12:
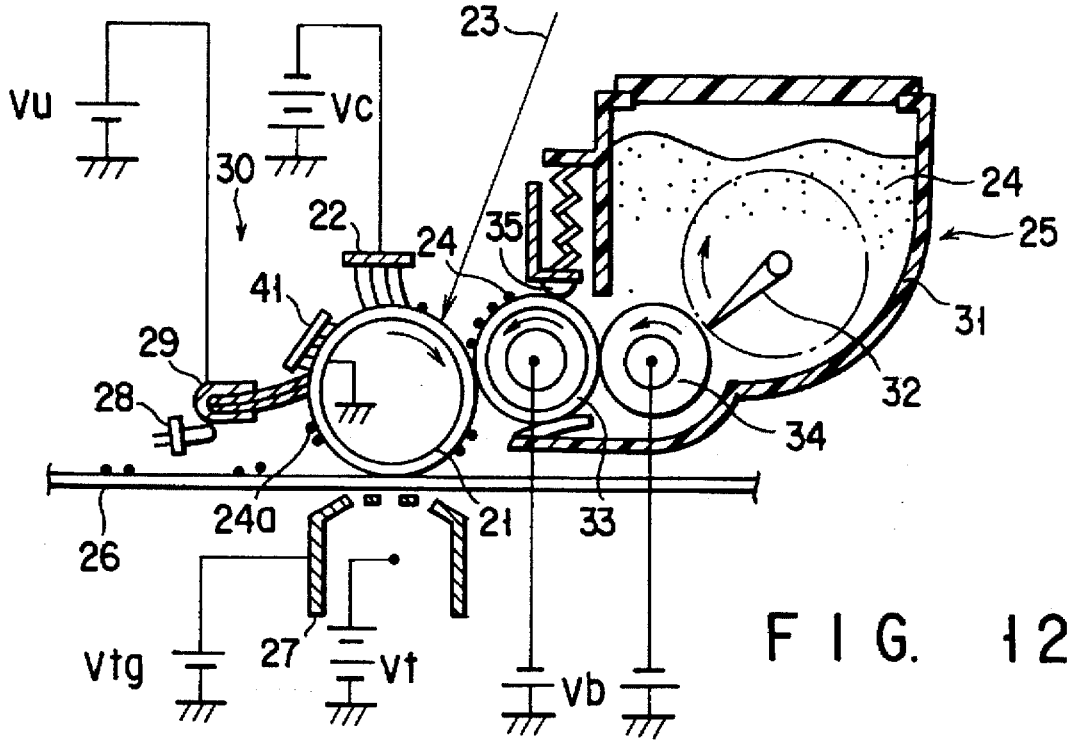
FIG. 12 shows a rough configuration of a cleanerless image forming apparatus according to a second embodiment of the present invention.

As shown in FIG. 12, the second embodiment uses a fixed scraping brush 41, which is a dispersive flexible contact member, as a scraping device. The remaining configuration of the second embodiment is the same as that of FIG. 3.

The fixed scraping device 41 is of the pile fabric type in which a brush is implanted in a metal plate. Rayon is used as fibrous material. The fiber thickness is set in the range from 10 denier to 30 denier, the fiber length in the range from 0.5 mm to 20 mm, the brush width in the range from 1.0 mm to 20 mm, and the density of implanted hair in the range from 100,000 hairs/cm$^2$ to 150,000 hairs/cm$^2$. The contact depth of the fixed scraping brush 41 to the photosensitive member 21 is set about in the range from 1 to 3 mm. Use of hard fiber, such as nylon, as brush fiber material enhances the scraping effect. A satin weave brush may be used as a brush. The satin weave brush reduces the clogging with the residual toner.

When such a fixed scraping brush 41 is used, the brush fibers are pressed against the photosensitive member surface in a dispersing manner, differently from the entire pressure contact with the elastic blade. Specifically, at the surface of the photosensitive member 21, the portions where the brush fibers are in contact with the surface and the portions where the brush fibers are not in contact with the surface disperse uniformly. The spacing between brush fibers makes it easier for the residual toner 24*a* to pass through the fixed scraping brush 41. This, together with the rolling effect of toner particles, makes the range of the effective contact conditions wider than the elastic blade. In addition, the brush fibers are superior to the elastic blade in flexibility and causes almost no abnormal wear of the photosensitive member even at the time when the photosensitive member 21 starts to rotate, resulting in a longer service life of the photosensitive member 21.

Figure 13:
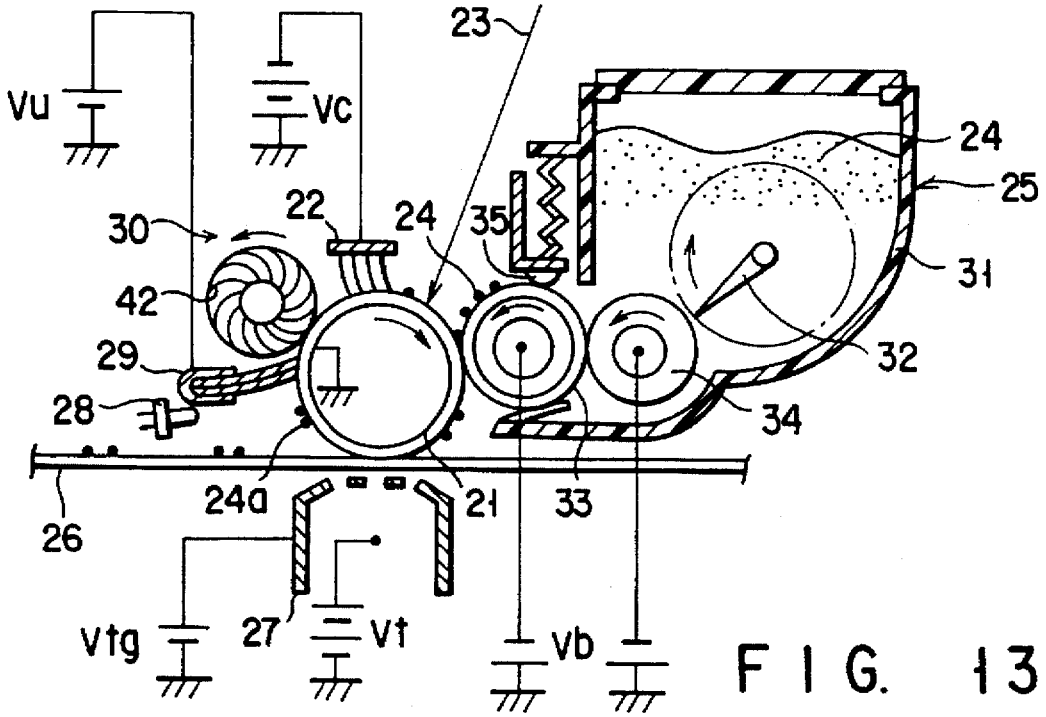
FIG. 13 shows a rough configuration of a cleanerless image forming apparatus using a scraping device with a rotary brush as a modification of the scraping device applied to the second embodiment.
Figure 14:
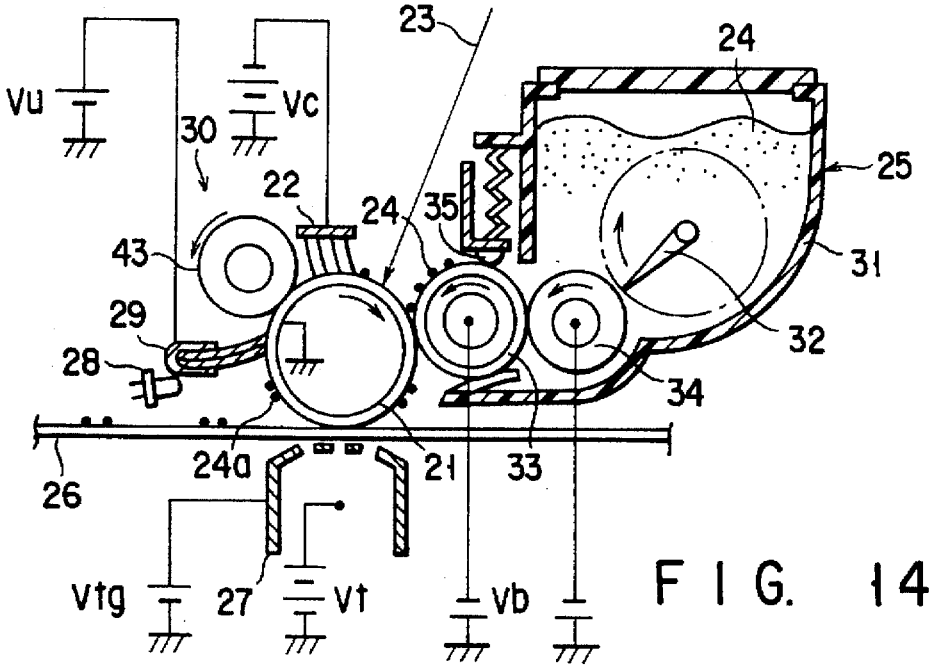
FIG. 14 shows a rough configuration of a cleanerless image forming apparatus using a scraping device with a rotary sponge roller as a modification of the scraping device applied to the second embodiment.

While in the second embodiment, the fixed scraping device 41 has been used as the scraping device, the present invention is not limited to this. For instance, the invention may be applied to a rotary scraping brush 42 as shown in FIG. 13 or a rotary scraping sponge roller 43 as shown in FIG. 14.

The rotary scraping brush 42 is such that brush fibers are implanted on a metal shaft to shape like a roller. The brush implanting conditions and the contact depth are the same as those for the fixed scraping brush 41. The direction in which the rotary scraping brush 42 rotates is set in the same direction of rotation of the photosensitive member 21 at the contact surface. The direction may be opposite. It is desirable that the rotation speed should differ from the peripheral speed of the photosensitive member surface and be 0.5 to 5.0 times the peripheral speed of the photosensitive member surface.

In a case where the fixed scraping brush 41 is used, because the same brush fibers are always in contact with the photosensitive member 21 in the peripheral direction in the same state, streaked wear traces are liable to develop in the peripheral direction of the photosensitive member 21, permitting a streaked pattern to appear on a high-resolution image. In the case of the rotary scraping brush 42, however, because different brush fibers are in contact with small portions of the photosensitive member 21 in different states and the different states are maintained almost uniformly all over the photosensitive member surface, the scraping brush scrapes the photosensitive member 21 uniformly. The accumulation of paper powder is also uniform, causing less local damage to the photosensitive member 21. Furthermore, as in the case of the elastic roller 38 of FIG. 11, since the removal of the harmful deposits and degraded layer and the passage control of the residual toner 24*a* can be performed on the basis of not only the contact depth but also the direction of rotation and the speed of rotation, it is possible to allow a latitude for the setting of scraping conditions, thereby coping with various types of toner and photosensitive member.

The rotary scraping sponge roller 43 is formed of, for example, urethane sponge. It is desirable that the contact depth of the roller to the surface of the photosensitive member 21 should be about in the range of 0.5 mm to 3.0 mm. The direction of rotation is set in the same as the direction of rotation of the photosensitive member 21 at the contact surface. The rotation direction may be opposite. It is favorable that the rotation speed should be about 0.5 to 5.0 times the peripheral speed of the photosensitive member surface. A material for the rotary scraping sponge roller 43 may be silicone sponge, or urethane sponge or silicone sponge impregnated with abrasive, in addition to urethane sponge.

The rotary scraping sponge roller 43 is simpler in configuration and easier to manufacture than the rotary scraping brush 42 and produces the same effect as the rotary scraping brush 42. A foamed elastic blade may be used in place of the rotary scraping sponge roller 43.

As described above, use of the scraping brushes 41, 42 or sponge roller 43 produces the same effect as the first embodiment. Since the brush or sponge (formed material) is pressed against the photosensitive member 21 dispersively and flexibly, this allows the residual toner 24*a* to pass through easily and causes less damage to the photosensitive member 21. In the case of the rotary scraping brush 42 or sponge roller 43, the range of the effective contact conditions can be set wider. This makes the accuracy of device components and the assembly accuracy less strict, which provides very favorable conditions in terms of productivity and manufacturing cost.

Next, an image forming apparatus according to a third embodiment of the present invention will be explained.

Figure 15:
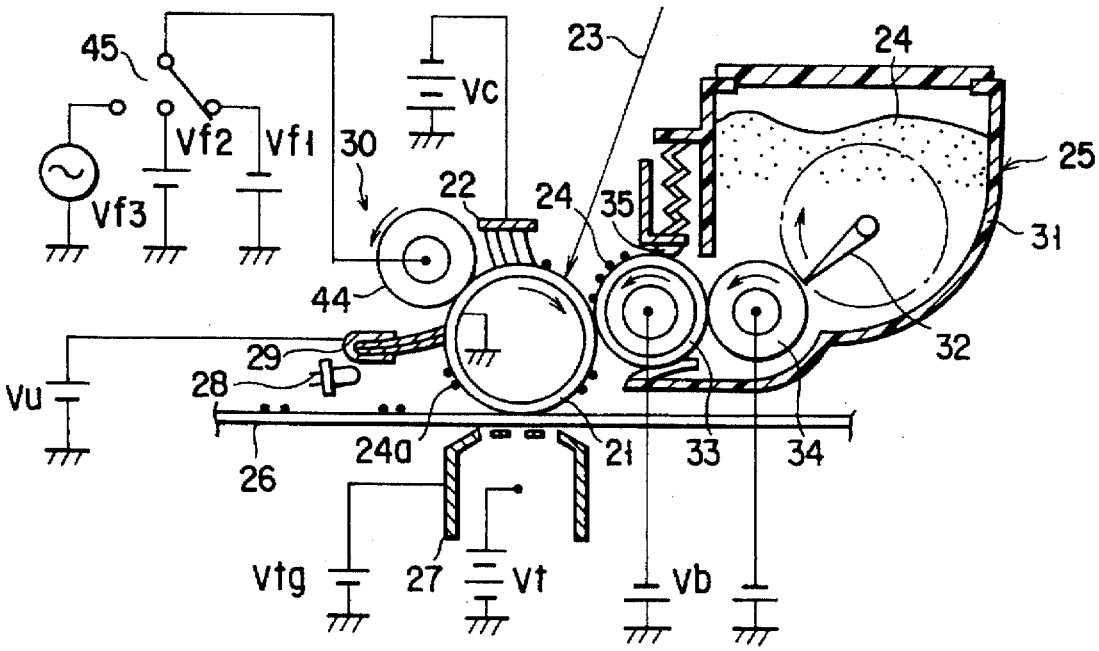
FIG. 15 shows a rough configuration of a cleanerless image forming apparatus according to a third embodiment of the present invention.

As shown in FIG. 15, a scraping device formed of a conductive member is used. Specifically, a conductivity rotary scraping sponge roller 44 is used as a scraping device. To the conductivity rotary scraping sponge roller 44, a negative direct voltage of Vf1, a positive direct voltage of Vf2, and an alternating-current voltage of Vf3 can be selectively applied by means of a selector switch 45.

A conductive member used for the conductive rotary scraping sponge roller 44 may be, for example, brush fiber made of conductive rayon or conductive nylon, conductive urethane sponge, conductive urethane sponge impregnated with abrasive, conductive urethane rubber, conductive silicone rubber, or a roller having a conductive or semiconductive urethane or Teflon surface layer provided on its surface made of the above material. These conductive brush fiber, sponge, and rubber have a volume resistivity of $10^2$ to $10^{10}\Omega\cdot$cm, preferably $10^3$ to $10^6\Omega\cdot$cm. The configuration, contact conditions, scraping conditions of these conductive scraping devices are the same as those in the aforementioned embodiments.

The applied voltages Vf1, Vf2, and Vf3 are set so that an electric field lower than the discharging start electric field with respect to the photosensitive member 21, for example, a direct-current and alternating-current electric fields of about ±500V or below, may be formed. The reason for this is that in an electric field equal to or higher than the discharging start electric field, products of discharging harmful to the formation of images will be generated at the conductive member.

Figure 16:
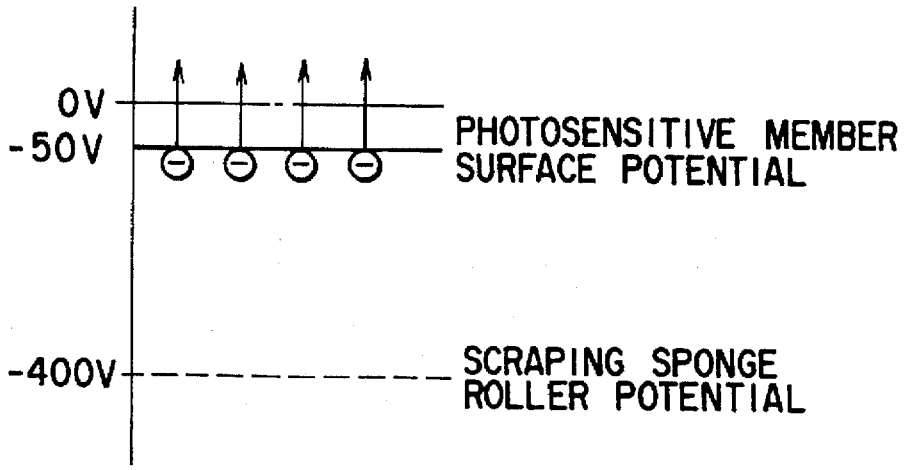
FIG. 16 is a pictorial diagram to help explain the action of suppressing the adhesion of the residual toner to the scraping sponge roller in the third embodiment.

A concrete voltage applying method is such that, for example, when a negatively charged organic photosensitive member is used as the photosensitive member 21 and negatively charged toner is used as the toner 24, a direct-current voltage of −400V (Vf1: adhesion suppressing voltage) is applied to the conductive rotary scraping sponge roller 44. The potential and the force acting on the toner are shown pictorially in FIG. 16.

Specifically, if the surface potential of the photosensitive member 21 after passing under the destaticizing lamp 28 is about −50V, the negatively charged residual toner 24*a* receives electrostatic force at the scraping position of the scraping sponge roller 44 in the direction in which the toner moves from the scraping sponge roller 44 to the surface of the photosensitive member 21, which suppresses the adhesion of the residual toner 24*a* to the scraping sponge roller 44, making it easy for the residual toner 24*a* to pass through.

Figure 17:
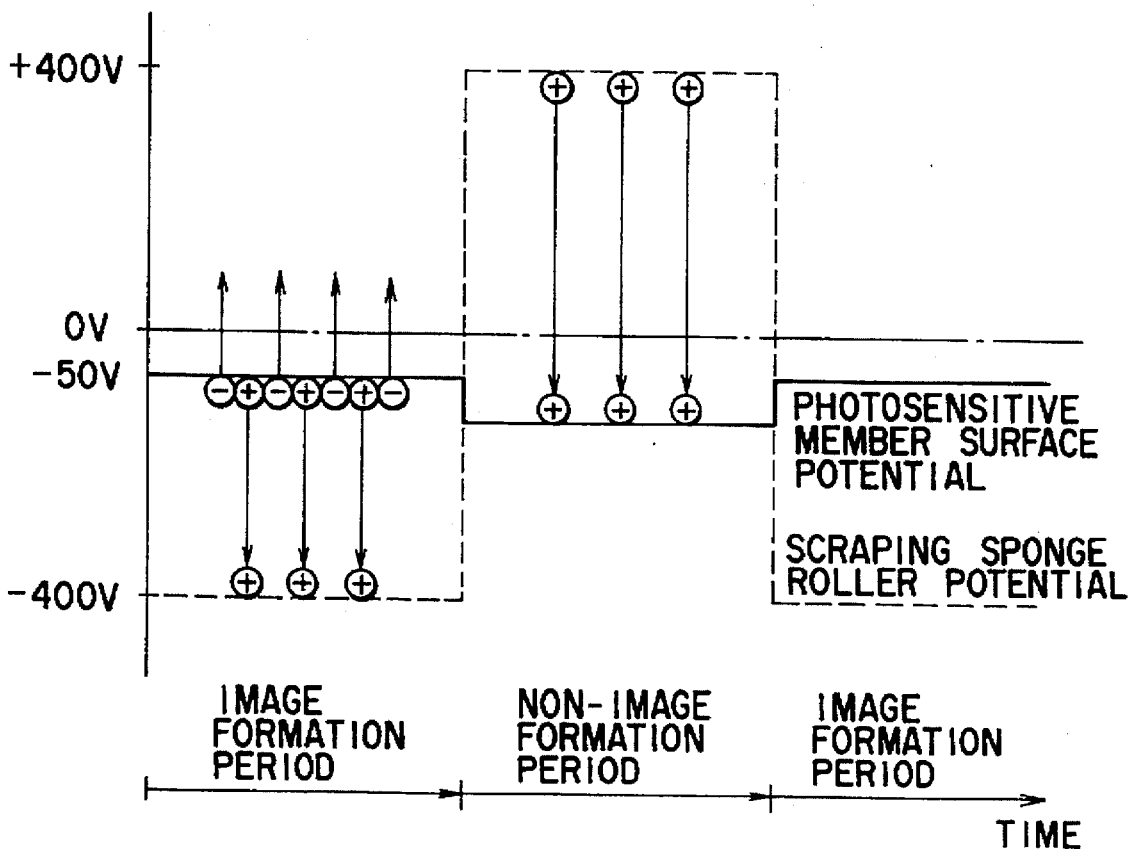
FIG. 17 is a pictorial diagram to help explain the action of forcing the residual toner to be released to the photosensitive member in the third embodiment.

Even if the adhesion suppressing voltage Vf1 is applied to make it difficult for the residual toner 24*a* to stick to the scraping sponge roller 44, a small amount of oppositely charged (positively charged) toner contained in the residual toner 24*a* will stick to the scraping sponge roller 44 by electrostatic force in the period of image formation as shown in FIG. 17. When a lot of images are formed, the positively charged (oppositely charged) toner accumulates on the scraping sponge roller 44 gradually.

To overcome this problem, with the timing of the leading or trailing edge of a sheet of recording paper 26 or the space between a sheet of recording paper 26 and the following one on the photosensitive member 21 arrives at the scraping position of the scraping sponge roller 44, that is, in the non-image formation period shown in FIG. 17, the selector switch 45 is switched to apply a forced release voltage Vf2 to the scraping sponge roller 44, which forces the oppositely charged toner accumulated on the scraping sponge roller 44 to be released onto the photosensitive member 21, thereby preventing the residual toner from accumulating on the scraping sponge roller 44 during the averaged time interval. Because no image is formed in the space between sheets of recording paper, almost no residual toner 24*a* after transfer exists.

Specifically, a direct-current voltage of +400V is applied to the scraping sponge roller 44 as the forced release voltage Vf2. If the surface potential of the photosensitive member 21 after passing under the destaticizing lamp 28 is about −100V, the negatively charged (oppositely charged) toner receives strong electrostatic force at the scraping position of the scraping sponge roller 44 in the direction in which the toner moves from the scraping sponge roller 44 to the surface of the photosensitive member, which forces the oppositely charged (positively charged) toner on the scraping sponge roller 44 to be released into the space between sheets of recording paper on the surface of the photosensitive member 21. The action of forcing toner to be released prevents the residual toner from accumulating on the scraping sponge roller 44 during the averaged time interval. Then, the released residual toner 24*a* is charged by the charging device 22 in the same polarity as that of the photosensitive member 21 and thereafter the residual toner 24*a* in the unexposed portion is recovered by the developing roller 33 of the developing device 25.

When the amount of transfer residual toner is very small and most of the residual toner is oppositely charged toner (e.g., spherical toner obtained by a polymerization method is used), an adhesion suppressing voltage Vf1 of +400V is applied and a forced release voltage Vf2 of −400V is applied, which is the reversal of what has been described just above.

When the polarity and amount of charges of the toner accumulated on the scraping sponge roller 44 vary, depending on the frictional charging, charge injection, and discharging, an alternating-current forced release voltage Vf3 is applied to the scraping sponge roller 44 during the non-image formation period. This forces the residual toner accumulated on the scraping sponge roller 44 to be released and prevents the residual toner from accumulating on the scraping sponge roller 44 during the averaged time interval.

Figure 18:
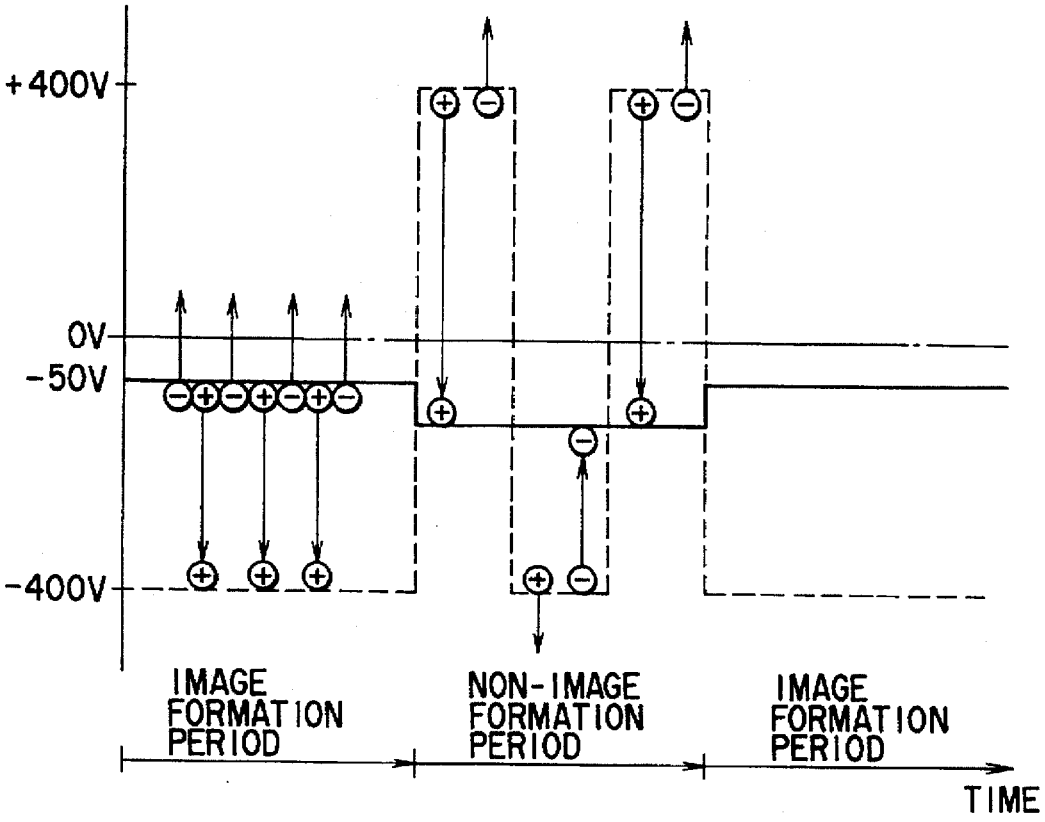
FIG. 18 is a pictorial diagram to help explain the action of forcing the residual toner to be released to the photosensitive member in the third embodiment.

Specifically, an alternating-current voltage with a peak difference of 800V (−400V to +400V) and a frequency of 200 Hz is applied. The potential at this time and the force acting on the toner are pictorially shown in the non-image formation period of FIG. 18. With the surface potential of the photosensitive member 21 after passing under the destaticizing lamp 28 being about −100V, when the scraping sponge roller 44 is applied with a positive voltage at the scraping position of the scraping sponge roller 44, the residual toner 24*a* positively charged by electrostatic force is caused to be released from the scraping sponge roller 44 to the photosensitive member surface. When the scraping sponge roller 44 is applied with a negative voltage, the residual toner 24*a* negatively charged by electrostatic force is caused to be released from the scraping sponge roller 44 to the photosensitive member surface.

The value of the voltage applied to the scraping sponge roller 44 is set so that the electric field caused by the voltage and the photosensitive member surface may control the force acting on the toner. For example, in a case where a negatively charged organic photosensitive member and negatively charged toner are used, when the surface potential of the photosensitive member 21 after passing under the destaticizing lamp 28 is about +500V (e.g., when the photosensitive member is forced to be positively charged by the transfer device), the adhesion suppressing voltage applied to the scraping sponge roller 44 is in the range of 0V to +100V. Under this condition, the negatively charged residual toner receives electrostatic force in the direction in which it moves from the scraping sponge roller 44 to the photosensitive member surface, thereby suppressing the adhesion of the residual toner 24*a* to the scraping sponge roller 44.

Therefore, the negatively charged residual toner does not necessarily require a negative adhesion suppressing voltage. The value of the voltage should be determined by the relative electric field relationship between the photosensitive member surface potential and the amount of charges of toner. This holds true for the forced release voltage.

As described above, with the suppression of the adhesion of the residual toner 24*a* and the forced release of the residual toner 24*a* by voltage application, when the contact depth of the scraping sponge roller 44 to the photosensitive member 21 is made greater to improve the scraping capability, this makes the adhesive force of the residual toner 24*a* larger and increases the amount of toner recovered. It is possible to keep a balance by making the adhesion suppressing voltage Vf1 and regulated release voltages Vf2, Vf3 larger to make the adhesion suppressing force larger and increase the amount of forced release.

Because the passage of the residual toner 24*a* can be controlled by the applied voltage conditions independently of the conditions for removing the deposits and degraded layer, including the contact depth, rotation direction, and rotation speed of the scraping sponge roller 44, when a nonconductive photosensitive member is used, the photosensitive member surface can be refreshed at the necessary minimum amount of wear of the photosensitive member by the rolling friction of toner particles as a result of the residual toner passing through, even under such relatively strong pressure contact conditions as the residual toner are stuck and recovered. Therefore, even with a conductive scraping device, such as brush fiber or a foamed member, it is possible to press the scraping device against the photosensitive member surface with high pressure reliably.

As described above, use of a conductive scraping device such as the conductive rotary scraping sponge roller 44, prevents the residual toner from accumulating on the scraping device even after many images have been formed, because of the effects of the residual toner adhesion suppressing voltage and residual toner forced release voltage as well as the effects obtained from the aforementioned embodiments. This makes the service life of the scraping device longer, making it possible to provide good images for a long time stably. In addition, since the suppression of the adhesion of the residual toner and the forced release of the residual toner enables the passage of the residual toner to be controlled by the applied voltage conditions, independently of the conditions for removing the deposits and degraded layer in the conductive scraping device, the range where the refreshing of the photosensitive member surface and the average time passage of the residual toner are compatible with each other can be made much wider.

Therefore, it is possible to give a relatively large leeway to the scraping conditions, which not only enables the device to cope with various types of toner and photosensitive member but also makes the accuracy of device components and the assembly accuracy less strict, providing very favorable conditions in terms of productivity and manufacturing cost. If toner were left accumulated on the conductive scraping device, it would be waste toner. The conductive scraping device used here, however, does not allow the residual toner to accumulate, but releases it, so that the residual toner can be recovered efficiently at the developing device without producing waste toner.

Next, an image forming apparatus according to a fourth embodiment of the present invention will be explained.

Figure 19:
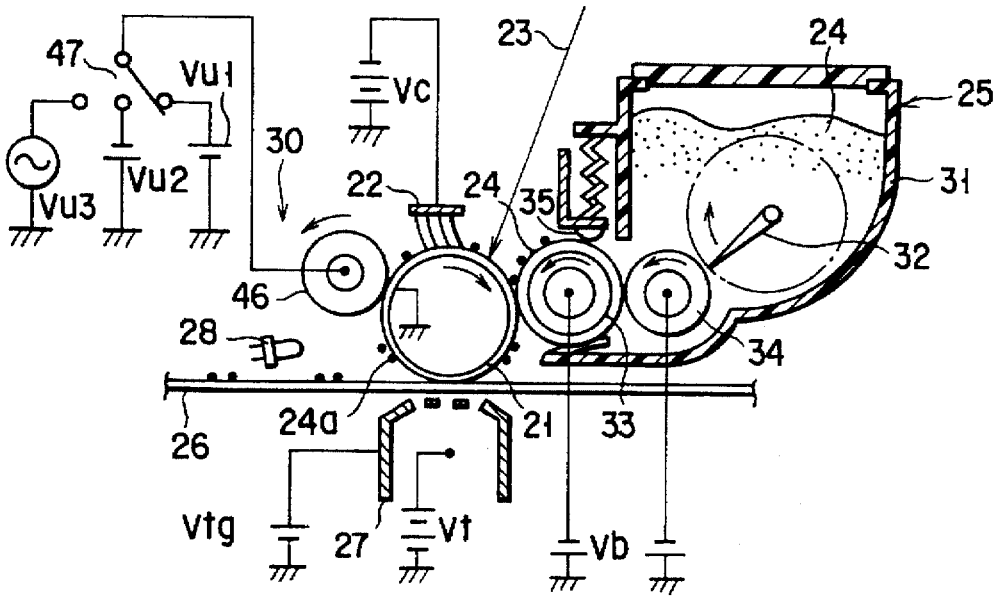
FIG. 19 shows a rough configuration of a cleanerless image forming apparatus according to a fourth embodiment of the present invention.

As shown in FIG. 19, the equalizing device 29 of FIG. 3 also serves as a scraping device. There is provided a scraping and equalizing device 46 formed of a conductive rotary sponge roller as an equalizing device. A scraping device is eliminated. A positive equalizing voltage Vu1, a negative equalizing voltage Vu2, and an alternating-current equalizing voltage Vu3 are selectively applied via a selector switch 47 to the scraping and equalizing device 46. In addition to the conductive rotary sponge roller, a conductive scraping blade, a conductive rotary scraping roller, a conductive fixed scraping brush, a conductive rotary scraping brush, or a conductive fixed scraping sponge blade may be used as the scraping and equalizing device 46. The contact conditions and scraping conditions for the scraping and equalizing device 46 with respect to the photosensitive member 21 are the same as those for the individual scraping devices used in the corresponding embodiments.

The applied voltages Vu1, Vu2, and Vu3 are set so that an electric field lower than the discharging start electric field with respect to the photosensitive member 21, for example, a direct-current and alternating-current electric fields of about ±500V or below may be formed. The reason for this is that in an electric field equal to or higher than the discharging start electric field, products of discharging harmful to the formation of images will be generated at the conductive member.

Figure 20:
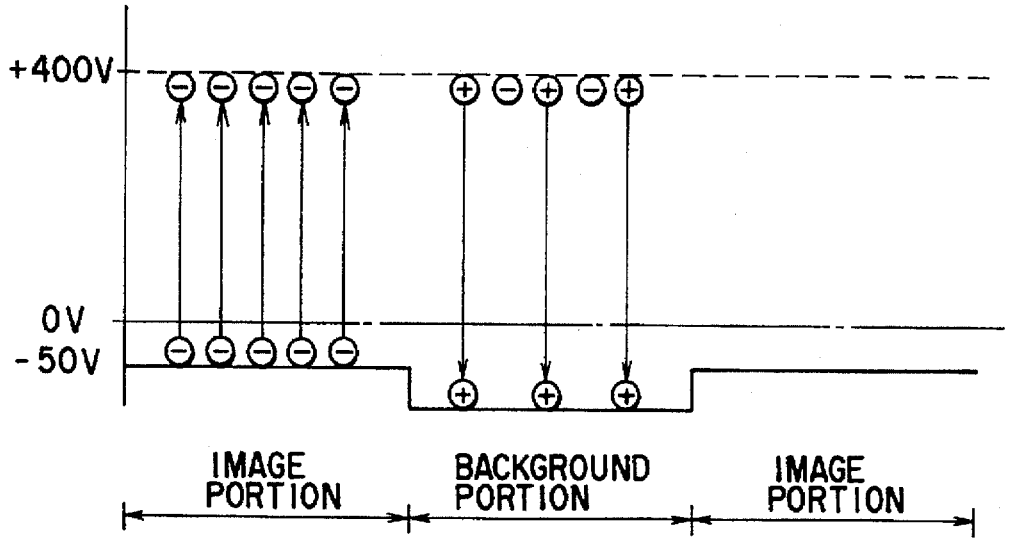
FIG. 20 is a pictorial diagram to help explain the action of sucking and releasing toner in a scraping and equalizing device in the fourth embodiment.

A concrete voltage applying method is such that, for example, when a negatively charged organic photosensitive member is used as the photosensitive member 21 and negatively charged toner is used as the toner 24, a direct-current voltage of +400V (Vu1: sucking voltage) is applied to the scraping and equalizing device 46. The potential and the force acting on the toner are shown pictorially in FIG. 20.

Specifically, if the surface potential of the image portion (exposed portion) of the photosensitive member 21 after passing under the destaticizing lamp 28 is about −50V, the negatively charged residual toner **24*a* receives electrostatic force at the scraping position of the scraping and equalizing device 46 in the direction in which the toner moves from the surface of the photosensitive member 21 to the scraping and equalizing device 46, which causes the residual toner 24*a* distributed in the image area to be sucked and recovered by the scraping and equalizing device 46. The toner sucking action reduces the amount of residual toner 24*a*** existing in the image portion.

Some of the negatively charged toner caught by the scraping and equalizing device 46 is oppositely charged (positively charged) as a result of frictional charging, charge injection, or discharging. If the surface potential of the background portion (unexposed portion) of the photosensitive member 21 after passing under the destaticizing lamp 28 is about −100V, the positively charged residual toner **24*a* receives electrostatic force in the direction in which the toner moves from the scraping and equalizing device 46 to the surface of the photosensitive member 21 at the scraping position of the scraping and equalizing device 46, which causes the positively charge toner on the scraping and equalizing device 46 to be released to the non-image portion on the photosensitive member surface. The toner releasing action causes a small amount of residual toner 24*a*** to stick to the background portion uniformly.

The residual toner sucking and releasing action equalizes the distribution of the residual toner on the photosensitive member to the extent that it has no effect on the charging and exposing processes. Furthermore, it achieves the equalization of the residual toner image necessary for the cleanerless image forming apparatus where no residual toner is allowed to accumulate in the scraping and equalizing device 46 and thereby no waste toner is produced.

When the amount of residual toner is large, however, a large amount of toner (negatively charged toner) must be sucked and recovered into the scraping and equalizing device 46. Because the toner releasing action cannot release a large amount of toner, there is a possibility that the amount of toner accumulated in the scraping and equalizing device 46 will increase or the toner will scatter inside the device.

Figure 21:
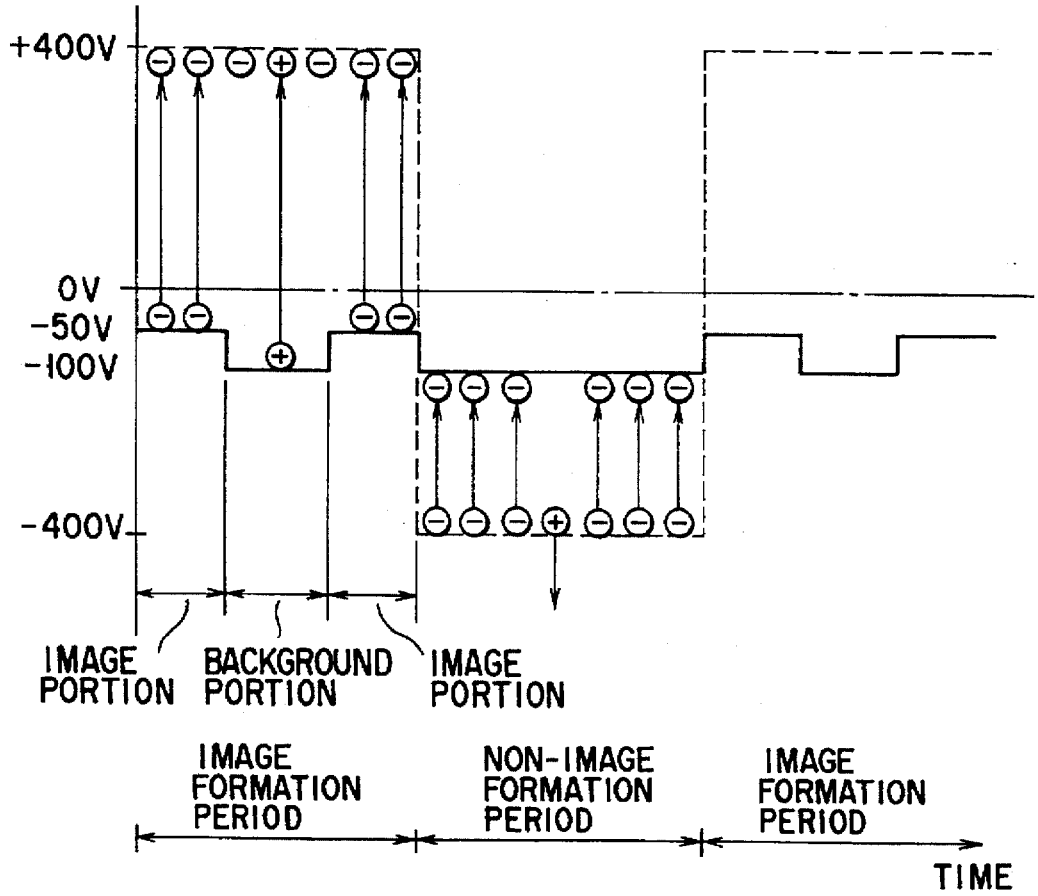
FIG. 21 is a pictorial diagram to help explain the action of forcing toner to be released in the scraping and equalizing device in the fourth embodiment.

To overcome this problem, when the space between sheets of recording paper is located at the scraping position of the scraping and equalizing device 46 (during the non-image formation period), the selector switch 47 is switched to apply a direct-current voltage of −400V (Vu2: forced release voltage) to the scraping and equalizing device 46. The potential at this time and the force acting on the toner are pictorially shown in FIG. 21.

Specifically, if the surface potential of the photosensitive member 21 after passing under the destaticizing lamp 28 is about −100V, the negatively charged residual toner **24*a*** receives strong electrostatic force at the scraping position of the scraping and equalizing device 46 in the direction in which the toner moves from the scraping and equalizing device 46 to the surface of the photosensitive member, which forces a large amount of negatively charged toner on the scraping and equalizing device 46 to be released into the space between sheets of recording paper on the surface of the photosensitive member 21. The action of forcing toner to be released prevents the residual toner from accumulating on the scraping and equalizing device 46 during the averaged time interval. Then, the released residual toner 24*a* is charged by the charging device 22 in the same polarity as that of the photosensitive member 21 and thereafter the residual toner 24*a* in the unexposed portion is recovered by the developing roller 33 of the developing device 25.

When the amount of residual toner is very small and most of the residual toner is oppositely charged, a sucking voltage Vu1 of −400V is applied and a forced release voltage Vu2 of +400V is applied.

When the polarity and amount of charges of the toner caught by the scraping and equalizing device 46 vary, depending on the frictional charging, charge injection, and discharging, an alternating-current Vu3 is applied to the scraping and equalizing device 46 during the non-image formation period to cause the scraping and equalizing device 46 to force toner to be released reliably. This forces the toner to be released to the portion of the photosensitive member corresponding to the space between sheets of recording paper. In this case, an alternating-current voltage with a peak difference of 800V (−400V to +400V) and a frequency of 200 Hz is applied.

As described above, by suitably setting the conditions for a voltage applied to the equalizing device, it is possible to cause the equalizing device to also function as a scraping device. Namely, the scraping and equalizing device 46 can perform not only selective cleaning by which the paper powder, harmful deposits, and photosensitive member surface degraded layer are removed and the residual toner is allowed to pass through but also the refreshing of the photosensitive member surface at a necessary minimum amount of wear of the photosensitive member. Furthermore, the scraping and equalizing device equalizes the residual toner image and prevents waste toner from being produced, which is the necessary function for a cleanerless image forming apparatus. The combination of an equaling device and a scraping device reduces the number of necessary component parts, helping make the apparatus more compact and manufacture the apparatus at lower cost.

Next, an image forming apparatus according to a fifth embodiment of the present invention will be explained.

Figure 22:
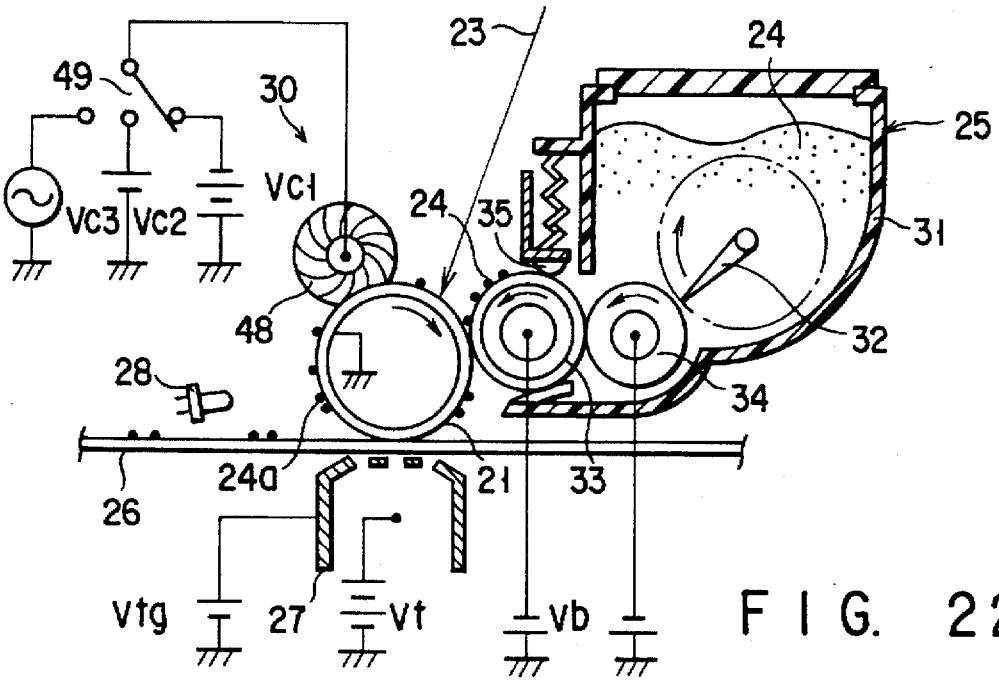
FIG. 22 shows a rough configuration of a cleanerless image forming apparatus according to a fifth embodiment of the present invention.

As shown in FIG. 22, a contact charging device also serves as an equalizing device and a scraping device. There is provided a scraping, equalizing, and charging device 48 formed of a conductive rotary scraping brush as a contact charging device. An equalizing device and a scraping device are eliminated. A negative voltage Vc1, a positive voltage Vc2, and an alternating-current voltage Vc3 are selectively applied via a selector switch 49 to the scraping, equalizing, and charging device 48. In addition to the conductive rotary scraping brush, a conductive rotary scraping roller, a conductive fixed scraping brush, or a conductive rotary scraping sponge roller may be used as the scraping, equalizing, and charging device 48. The contact conditions and scraping conditions for the scraping, equalizing, and charging device 48 with respect to the photosensitive member 21 are the same as those for the individual scraping devices used in the corresponding embodiments.

For example, when a negatively charged organic photosensitive member is used as the photosensitive member 21 and negatively charged toner is used as the toner 24, a direct-current voltage (Vc1) of −1000V is applied to the scraping, equalizing, and charging device 48. Under these conditions, when the charging start voltage to the photosensitive member 21 produced by contact charging of the scraping, equalizing, and charging device 48 is −500V, the application of a direct-current voltage of −1000V causes the photosensitive member surface to be charged at −500V. At the same time, the residual toner 24*a* on the photosensitive member surface is also charged negatively, enabling the developing roller 33 of the developing device 25 to recover the toner.

The charging of the surface of the photosensitive member 2 and the residual toner 24*a* is not started simultaneously all over the conductive rotary scraping brush acting as the scraping, equalizing, and charging device 48. The charging is started, depending on the state where the conductive rotary scraping brush is in contact with the photosensitive member 21 (the state of the space between the surface of the conductive rotary scraping brush and the unevenness of the photosensitive member surface). Therefore, some of the residual toner 24*a* comes into contact with the conductive rotary scraping brush before the charging of the residual toner 24*a* is started.

Thus, when the amount of residual toner is very small and the recovery of only the oppositely charged toner (positively charged toner) in the residual toner prevents the generation of a memory phenomenon, the residual toner 24*a* is sucked and recovered into the scraping, equalizing, and charging device 48, preventing the generation of image defects, such as a memory phenomenon.

When only a direct-current voltage (Vc1) is applied to the scraping, equalizing, and charging device 48, however, this makes it easy for the toner charged in the opposite polarity to that of the toner stuck and suppressed by the electric field formed by the voltage (Vc1) and the photosensitive member surface to accumulate on the conductive rotary scraping brush that comes into contact with the photosensitive member 21. Therefore, it is necessary to apply a forced release voltage to the scraping, equalizing, and charging device 48 during the non-image formation period.

Specifically, when a negatively charged organic photosensitive member is used as the photosensitive member 21 and negatively charged toner is used as the toner 24, the selector switch 49 is switched during the non-image formation period to apply a direct-current voltage of +400V (Vc2: forced release voltage) to the scraping, equalizing, and charging device 48.

When the polarity and amount of charges of the toner caught by the scraping, equalizing, and charging device 48 vary, depending on the frictional charging, charge injection, and discharging, the selector switch 49 is switched during the non-image formation period to apply an alternating-current voltage of −400V to +400V (Vc3) to the scraping, equalizing, and charging device 48.

As described above, the setting of the conditions for the applied voltage enables the scraping, equalizing, and charging device 48 to equalize the residual toner image and charge the photosensitive member and the residual toner. Accordingly, the scraping, equalizing, and charging device 48 has the selective cleaning function that removes the paper powder, harmful deposits, and photosensitive member surface degraded layer and allows the residual toner to pass through, the function of refreshing the photosensitive member surface at a necessary minimum amount of wear of the photosensitive member, the function of equalizing the residual toner image and preventing waste toner from being produced, and the function of charging the photosensitive member and residual toner. Elimination of a scraping device and an equalizing device this way enables the apparatus to be made more compact and be manufactured at lower cost.

Next, an image forming apparatus according to a sixth embodiment of the present invention will be explained.

In this embodiment, a developing device 25 also serves as a scraping device. The configuration of the sixth embodiment is that of FIG. 3 from which the scraping device 30 is eliminated. In this embodiment, the developing device 25 removes the paper powder, products of discharging, toner deposits, precipitates from paper and toner, and degraded layer at the photosensitive member surface.

The developing device 25 is provided with a developing roller 33 that is in contact with the photosensitive member 21. The developing roller 33 scrapes the photosensitive member 21, which removes the harmful deposits on the photosensitive member 21 and the degraded layer, thereby refreshing the photosensitive member surface. It goes without saying that the developing device recovers the residual toner 24*a* and at the same time, performs development.

Specifically, the developing roller 33 is composed of a conductive elastic roller obtained by providing a conductive urethane rubber layer with a hardness of 30 (JIS-A) around a metal shaft, applying a conductive urethane coating on the surface of the rubber roller, and making adjustment so that the resistance between the metal shaft and the conductive urethane coating surface may be $10^8\Omega\cdot$cm or less. In addition to this, a material obtained by dispersing conductive carbon particles, metal particles, or metal fibers into urethane rubber, silicone rubber, ethylene propylene rubber, nitrile rubber (NBR), chloroprene rubber, or butyl rubber to achieve a resistance of $10^{10}\Omega\cdot$cm or less may be used as the conductive elastic roller. In addition, a material obtained by applying a coating of conductive or semiconductive urethane resin, silicone resin, or fluoroplastic on the surface of the conductive elastic roller layer, may be used.

Furthermore, the addition of scraping abrasive to the conductive elastic roller promotes the removal of the paper powder, products of discharging, toner deposits, degraded layer at the photosensitive member surface, and precipitates from paper and toner. It is desirable that particles with a diameter ranging from 0.01 to 1.0 μm should be used for a toner diameter of 10 μm, for example, as particles having the abrasive effect. Strontium titanate, cerium oxide, aluminium oxide, silicon carbide, silicon oxide, or barium titanate may be used as abrasive particle material. The conductive elastic roller contains 0.1 wt % to 10 wt %, and preferably 0.5 wt % to 5 wt %, by weight of any of these materials.

Furthermore, it is favorable that the contact depth of the developing roller 33 to the photosensitive member 21 should be made greater than that under normal contact development conditions and determined to be 0.1 to 1.0 mm. After the image formation has been completed, as the photosensitive member 21 is caused to rotate a specified number of times, while being charged, the developing roller 33 is also rotated, which removes the harmful deposits on the photosensitive member 21 and the degraded layer, thereby refreshing the photosensitive member. The rotation speed of the photosensitive member may be the same as during the image formation period or be faster to shorten the rotation time. It is desirable that the rotation speed should be about 1.2 to 5 times the peripheral speed of the photosensitive member 21.

Providing the developing roller 33 of the developing device 25 with the function of a scraping device enables the developing device to perform not only selective cleaning by which the paper powder, harmful deposits, and photosensitive member surface degraded layer are removed and the residual toner is allowed to pass through but also the refreshing of the photosensitive member surface at a necessary minimum amount of wear of the photosensitive member. Additionally, the developing device has the following advantages:

(1) Simultaneous cleaning and development has the function of sucking toner (cleaning) and releasing toner (development). Therefore, a special power supply for control of the sucking and releasing of toner is not needed.

(2) In the case of the developing device, since the residual toner can be recovered into the developing device, the amount of residual toner retained is not limited differently from the aforementioned embodiments, which makes it unnecessary to control the suppression of the adhesion of toner (or the suction of toner) during the image formation period and the release of toner during the non-image formation period.

(3) Because the toner on the developing roller is arranged by a toner layer thickness limiting member 35 to form a layer of a specific thickness, the photosensitive member 21 can be ground uniformly by the rolling friction of toner particles.

(4) Since the developing roller is rotating, a rotary scraping method can be used, which enables the photosensitive member to be ground without a special mechanism.

(5) Since the developing roller is pressed against the photosensitive member, contact pressure can be set without providing a special pressing mechanism.

As described above, providing the developing device with the function of a scraping device has no adverse effect on the original simultaneous cleaning and developing function of the developing device. Furthermore, elimination of a special scraping device helps make the apparatus more compact and manufacture the apparatus at lower cost.

Next, an image forming apparatus according to a seventh embodiment of the present invention will be explained.

Figure 23:
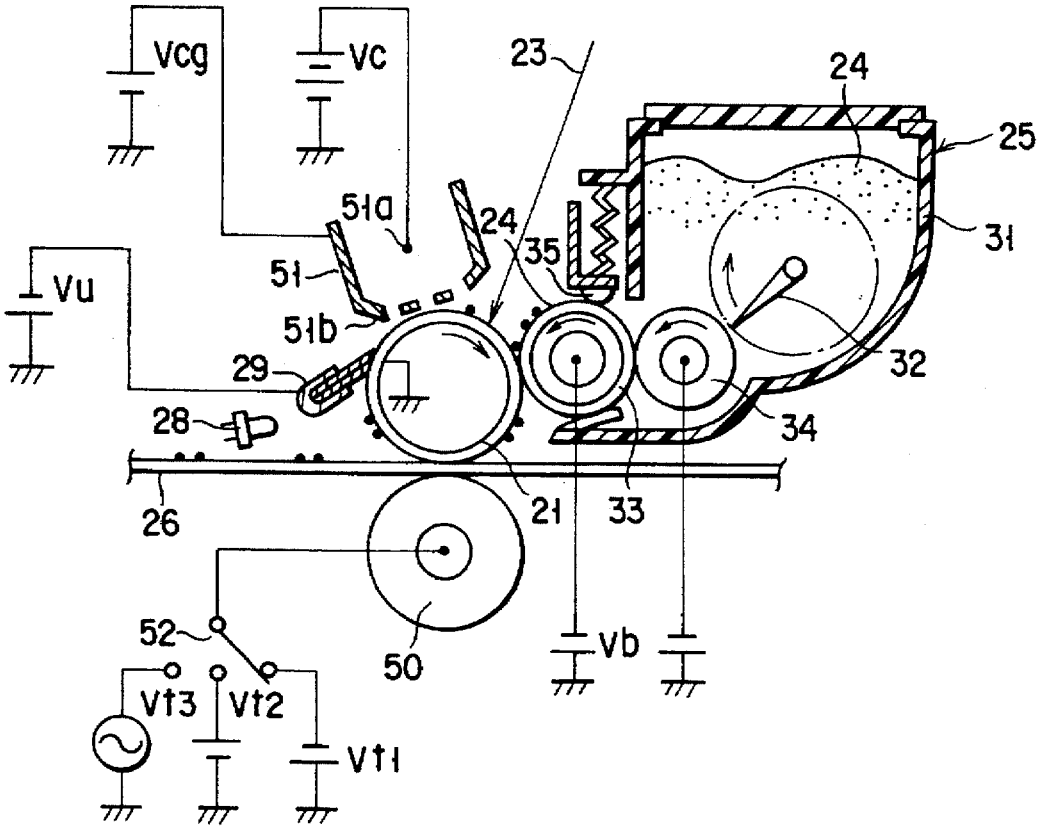
FIG. 23 shows a rough configuration of a cleanerless image forming apparatus according to a seventh embodiment of the present invention.

As shown in FIG. 23, a transfer device also serves as a scraping device. In place of the scorotron-type transfer device 27, a scraping and transfer device using a transfer roller 50 is provided. Furthermore, a scorotron-type charging device 51 is used as a charging device. A negative voltage Vt1, a positive voltage Vt2, and an alternating-current voltage Vt3 are selectively applied via a selector switch 52 to the transfer roller 50. The charging device 51 applies not only a charging voltage Vc to a charging corona wire 51*a* but also a charging grid voltage Vcg to a charging grid-mounted shield case 51*b*.

The apparatus uses a positively charged organic photosensitive member as the photosensitive member 21 and positively charged toner as the toner 24. The apparatus also uses not only the charging device which performs positive corona charging that generates a small amount of ozone but also the transfer roller 50 that generates almost no ozone. As a result, it is possible to reduce the amount of ozone generated.

The positively charged toner 24 is uni-component non-magnetic positively charged toner obtained by using polyester resin in which carbon, a polarity control agent, wax, etc. are distributed as a parent material, breaking it into nonspherical particles with an average radius of 10 μm by a grinding method, classifying them, and externally adding fine silica particles. A single-layer negatively charged organic photosensitive member using perylene pigment as charge generating material, hydrazone derivative as charge conveying material, polycarbonate as binder resin, is used as the photosensitive member 21.

The transfer roller 50 is composed of a semiconductive elastic roller with a resistance of $10^3$ to $10^9\Omega\cdot m$ obtained by providing a conductive urethane sponge layer with a hardness of 30 (JIS-A) around a metal shaft, applying conductive vinyl chloride onto the surface of the layer, and forming a fluorine film as an outermost layer. In addition to this, an elastic roller the surface of whose conductive or semiconductive elastic roller layer made of material obtained by dispersing conductive carbon particles, metal particles, or metal fibers into silicone sponge, urethane rubber, silicone rubber, ethylene propylene rubber, nitrile rubber (NBR), chloroprene rubber, or butyl rubber is coated with a conductive or semiconductive urethane resin, silicone resin, or fluorine resin, may be used as the transfer roller 50.

With the apparatus, because the transfer roller 50 is in contact with the recording paper 26 during the image formation period, the transfer roller 50 cannot get into contact with the photosensitive member 21. Thus, during the non-image formation period, that is, when the recording paper 26 is absent between the transfer roller 50 and the photosensitive member 21, the harmful deposits on the photosensitive member and the degraded layer are removed by the transfer roller 50 by causing not only the photosensitive member 21 to rotate a specified number of times, while charging it, but also the transfer roller 50 to rotate, which refreshes the photosensitive member surface. The rotation speed of the transfer roller 50 may be the same as during the image formation period or be faster to shorten the rotation time. It is desirable that the rotation speed should be about 1.2 to 5 times the peripheral speed of the photosensitive member 21. Furthermore, the contact depth of the transfer roller 50 to the photosensitive member 21 is made greater than during a normal contact charging period. It is favorable that the contact depth should be 0.1 to 1 mm.

To force the toner 24 accumulated on the transfer roller 50 to be released to the photosensitive member 21 during the non-image formation period, the selector switch 52 is switched to apply a positive direct-current voltage (Vt2) to the transfer roller 50. When the polarity and amount of charges of the toner caught by the transfer roller 50 vary, depending on the frictional charging, charge injection, and discharging, the selector switch 52 is switched during the non-image formation period to apply an alternating-current voltage (Vt3) to the transfer roller 50.

As described above, the suitable setting of the conditions for a voltage applied to the transfer roller 50 enables the transfer device to serve as a scraping device. Specifically, the transfer roller 50 performs not only selective cleaning by which the paper powder, harmful deposits, and photosensitive member surface degraded layer are removed and the residual toner is allowed to pass through but also the refreshing of the photosensitive member surface at a necessary minimum amount of wear of the photosensitive member. Since the transfer roller 50 is rotating, a rotary scraping method can be used, which enables the photosensitive member to be ground uniformly without a special mechanism. In addition, since the transfer roller 50 is pressed against the photosensitive member, contact pressure can be set without a special pressing mechanism.

As described above, providing the transfer device with the function of a scraping device has no adverse effect on the original function of the transfer device. Furthermore, elimination of a special scraping device helps make the apparatus more compact and manufacture the apparatus at lower cost.

While in the embodiment, a transfer roller is used as the transfer device, a transfer belt may be used in place of the transfer roller.

While in the fourth to seventh embodiments, an equalizing device also serving as a scraping device, a charging device also serves as an equalizing device and a scraping device, a developing device also serving as a scraping device, and a transfer device also serving as a scraping device have been explained, each of an equalizing device, a charging device, a developing device, and a transfer device may also have the function of a scraping device and refresh the surface of the photosensitive member 21 little by little, for example. In that case, for example, the equalizing device may have the function of removing paper powder, the charging device have the function of removing the photosensitive member surface degraded layer, and the developing device have the function of removing the products of discharging.

Although in each of the above embodiments, nonspherical toner is used as toner, the present invention is not limited to this. For instance, spherical toner may be used.

For example, in the same configuration as that of the first embodiment of FIG. 3, when the scraping device 30 is pressed strongly against the photosensitive member 21, the scraping and grinding effects of the photosensitive member 21 are improved, but the residual toner 24*a* is also removed, impairing the advantage of the cleanerless image forming apparatus of generating no waste toner. When a large amount of residual toner 24*a* is accumulated in the scraping device 30, this contributes to a decrease in the scraping capability of the scraping device 30 or the contamination of the scraping device with toner. Furthermore, when the pressure at which the scraping device 30 is pressed against the photosensitive member 21 is made higher, this causes the photosensitive member to be ground too much, which leads to the occurrence of defective images and shortens the service life of the photosensitive member seriously.

On the other hand, when the pressure at which the scraping device 30 is pressed against the photosensitive member 21 is low, the scraping and grinding effects at the photosensitive member surface are insufficient, so that the harmful deposits on the photosensitive member and the degraded layer cannot be removed, shortening the service life of the photosensitive member seriously.

Thus, the press contact conditions for the scraping device 30 are limited to the range where the advantages of the cleanerless image forming device are compatible with the refreshing of the photosensitive member surface. Use of spherical toner, however, enables toner to pass through the press contact section between the scraping device and the photosensitive member easily, widening the optimum range of the press contact conditions for the scraping device 30.

Explained next will be the results of experiments conducted using spherical toner in the image forming apparatus of FIG. 3.

The scraping device 30 scrapes and removes the products of discharging, toner deposits, precipitates from paper and toner, and photosensitive member surface degraded layer, all harmful to the image formation, and thereby refreshes the photosensitive member surface. In that case, the scraping device performs selective cleaning by which the residual toner is allowed to pass through but the deposits and degraded layer harmful to the image formation are scraped and removed. The conditions for the selective cleaning are related to the contact depth of the elastic blade 30*a* of the scraping device 30 to the photosensitive member 21. The relationship between the contact depth, the passage and removal of the residual toner, harmful deposits, and degraded layer, and the amount of wear of the photosensitive member 21 is shown in FIG. 24.

The elastic blade 30*a* used in the experiments was made of urethane rubber (1.8 mm in thickness, #1265, manufactured by BANDO CHEMICALS Co.). The spherical toner used in the experiments was manufactured by a known polymerization method. Those manufacture by a grinding method may be used. Namely, it is known that those similar to spherical toner can be manufactured in a fine grinding process using a known or turbomill by a grinding method.

The spherical toner manufactured by the polymerization method was shaped like almost a true sphere, and was uni-component non-magnetic negatively charged toner obtained by externally adding hydrophobic silica with an average particle diameter of 11 nm to toner parent material with a volume average particle diameter of 9 μm obtained by distributing carbon black metalized azo pigment polypropylene into styrene-acrylic resin. The contact angle of the elastic blade 30*a* to the photosensitive member 21 was determined to be 30°.

The experiments showed that by the use of such spherical toner, the toner and paper powder passed through but the harmful deposits and degraded layer were removed with the contact depth ranging from 0.1 mm to 0.2 mm; the toner passed through but the paper powder, harmful deposits, and degraded layer were removed with the contact depth ranging from 0.3 mm to 0.6 mm; and the toner passed through but part of the toner (a very small amount of toner), paper powder, harmful deposits, and degraded layer were removed with the contact depth ranging from 0.7 mm to 1.5 mm. That is, by the use of spherical toner, even when the contact depth of the elastic blade 30*a* to the photosensitive member 21 is set in the range from 0.3 mm to 1.5 mm, preferably in the range from 0.3 mm to 0.6 mm, selective cleaning can be effected by which the toner is allowed to pass through but the paper powder, harmful deposits, and degraded layer can be removed. Thus, as compared with the case where non-spherical toner of FIG. 4 is used, the range of the depth contact where selective cleaning can be effected is widened.

Figure 25:
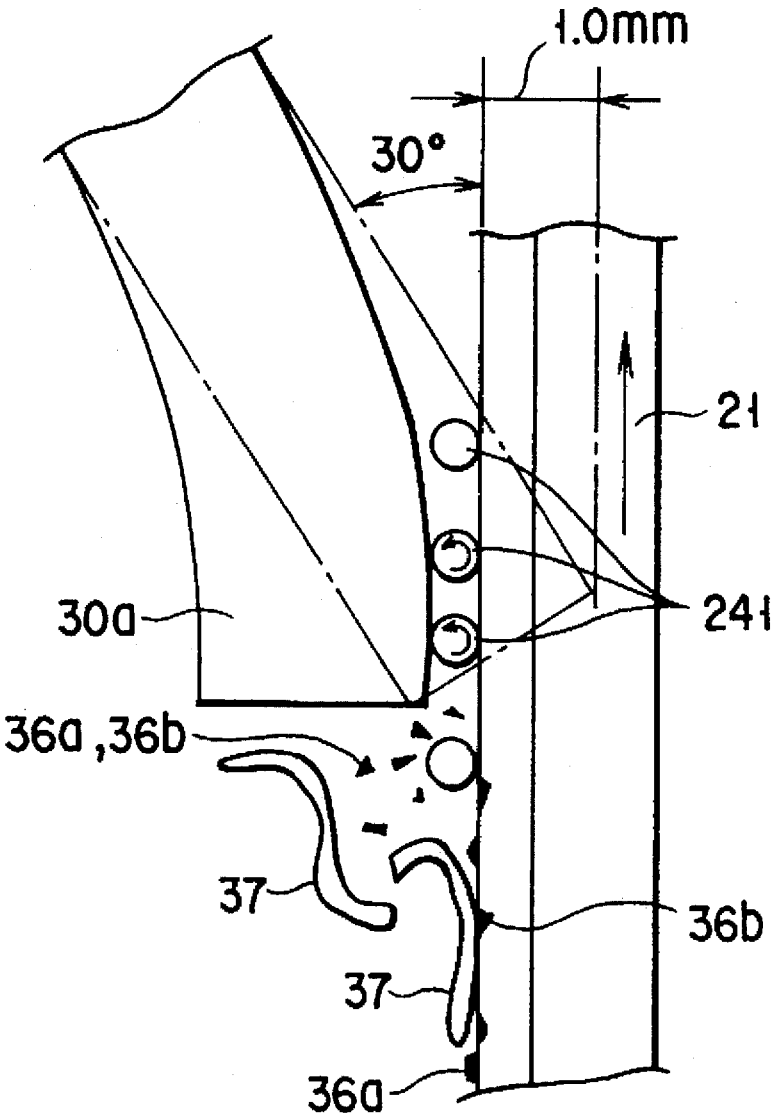
FIG. 25 is a pictorial diagram to help explain the scraping action of the elastic blade when spherical toner is used.

FIG. 25 pictorially shows what has explained just above. Specifically, since the shape of the residual toner 241 sandwiched between the elastic blade 30*a* and the photosensitive member 21 is spherical, the toner passes through, while rotating, in such a matter that it slips under the elastic blade, even under strong pressure contact conditions that the contact depth of the elastic blade 30*a* to the photosensitive member 21 is 1.0 mm. At this time, the surfaces of the toner particles give rolling friction to the surface of the photosensitive member, thereby removing the harmful deposits 36*a* on the photosensitive member 21 and the degraded layer 36*b*. Because the paper powder 37 is relatively large, it is removed directly by the elastic blade 30*a*. When the residual toner 24*a* is sparse, the elastic blade 30*a* touches the surface of the photosensitive member 21 directly. At this time, not only the paper powder 37 but also the harmful deposits 36*a* and degraded layer 36*b* are removed directly by the elastic blade 30*a*.

While the experiments has been explained using the case where spherical toner is used in the first embodiment, the same holds true for the other embodiments. Because use of spherical toner makes the scraping conditions wider than use of non-spherical toner, this makes the accuracy of device components and the assembly accuracy less strict, facilitating the improvement of the productivity and the reduction of manufacturing cost.

As described above, use of spherical toner capable of improving the picture quality enables the high-picture quality to be maintained for a long time by refreshing the photosensitive member surface. Since spherical toner is superior in transferability, the amount of residual toner produced is small. Furthermore, since spherical toner is superior in resistance to atomization, it will not be broken into finer particles, even undergoing strong contact pressure due to scraping. Spherical toner exerts small frictional force on the photosensitive member. Therefore, spherical toner is best suitable for use with a cleanerless image forming apparatus with a scraping device.

Next, the effect of externally adding to the toner an abrasive for scraping the photosensitive member surface will be described.

It is desirable that the diameter of abrasive particles should be 0.01 to 1.0 μm for toner with a particle diameter of about 10 μm, for example. Particle material may be silica, aluminum, or barium titanate, or a mixture of these. The mixing ratio of any of these materials to the whole toner by weight is preferably 0.1 wt % to 10 wt %.

By the use of abrasive-added toner, for example, when the toner passes through a scraping device made of a blade, brush, or roller or a device also serving as a scraping device, the toner particles give rolling friction to the photosensitive member surface and thereby removes the deposits on the photosensitive member surface and the degraded layer. At this time, the abrasive acts as abrasive grains, it grinds the photosensitive member surface in extremely small quantities uniformly. As a result, even when the contact pressure of the scraping device or the device also serving as a scraping device is relatively low, the deposits strongly stuck to the photosensitive member or the degraded layer are removed efficiently. In addition, the contact pressure of the scraping device or the device also serving as a scraping device can be reduced, it is easy for the toner to pass through the pressure contact section between the scraping device or the device also serving as a scraping device and the photosensitive member.

While in the first to sixth embodiments, the negatively charging process using a negatively charged photosensitive member and negatively charged toner has been explained, in the seventh embodiment, the positively charged process using a positively charged photosensitive member and positively charged toner has been described, both the negatively charged process and the positively charged process can be used in the individual embodiments.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

an image holding member;

a charging device for charging a surface of said image holding member at a constant potential;

an exposing device for exposing said image holding member charged by said charging device to form an electrostatic latent image;

a developing device for developing said electrostatic latent image by selectively sticking toner to the surface of said image holding member so as to form a toner image corresponding to the electrostatic latent image formed by said exposing device; and a transfer device for transferring to a transfer material the toner image formed by said developing device on the surface of said image holding member, wherein said developing device develops the toner image and simultaneously sucks and recovers residual toner remaining on the surface of said image holding member after transfer, and wherein said image forming apparatus further comprises a scraping device that is pressed against the surface of said image holding member and scrapes the surface of said image holding member, while allowing said residual toner to pass through.

2. An image forming apparatus according to claim 1, wherein said scraping device includes an elastic blade having an edge section that is in contact with the surface of said image holding member at a specific pressure and scrapes the surface of said image holding member, while allowing said residual toner to pass through.

3. An image forming apparatus according to claim 1, wherein said scraping device includes an elastic blade having a flat surface portion that is in contact with the surface of said image holding member at a specific pressure and scrapes the surface of said image holding member, while allowing said residual toner to pass through.

4. An image forming apparatus according to claim 1, wherein said scraping device includes an elastic blade having a curved surface portion that is in contact with the surface of said image holding member at a specific pressure and scrapes the surface of said image holding member, while allowing said residual toner to pass through.

5. An image forming apparatus according to claim 1, wherein said scraping device includes an elastic roller that is in contact with the surface of said image holding member at a specific pressure and scrapes the surface of said image holding member, while allowing said residual toner to pass through.

6. An image forming apparatus according to claim 1, wherein said scraping device includes a brush that is in contact with the surface of said image holding member at a specific pressure and scrapes the surface of said image holding member, while allowing said residual toner to pass through.

7. An image forming apparatus according to claim 1, wherein said scraping device includes:

a conductive scraping member that is in contact with the surface of said image holding member at a specific pressure; and a voltage applying device for selectively applying a direct-current voltage of a specific polarity and an alternating-current voltage to said conductive scraping member, and wherein said scraping device scrapes the surface of said image holding member, while allowing said residual toner to pass through.

8. An image forming apparatus according to claim 1, wherein said scraping device comprises a device for scraping the surface of said image holding member, while allowing said residual toner to pass through, and for equalizing a distribution of said residual toner.

9. An image forming apparatus according to claim 1, wherein said scraping device includes a charging device for scraping the surface of said image holding member, while allowing said residual toner to pass through, and for charging the surface of said image holding member at a constant potential.

10. An image forming apparatus according to claim 1, wherein said scraping device includes a developing device for scraping the surface of said image holding member, while allowing said residual toner to pass through, and for selectively sticking toner to the surface of said image holding member so as to correspond to the electrostatic latent image.

11. An image forming apparatus according to claim 1, wherein said scraping device includes a transfer device for scraping the surface of said image holding member, while allowing said residual toner to pass through, and for transferring to a transfer material the toner image formed on the surface of said image holding member.

12. An image forming apparatus according to claim 1, wherein said toner comprises spherical toner.

13. An image forming apparatus according to claim 1, wherein said scraping device includes an elastic member that is in contact with the surface of said image holding member at a specific pressure, said specific pressure being determined so as to prevent said elastic member from floating more than a specific height above said image holding member, and wherein said scraping device removes part of the surface of said image holding member by allowing said toner to pass through a space formed between said elastic member and said image holding member as a result of the floating of said elastic member, while rotating said toner.

14. An image forming apparatus according to claim 2, wherein said toner comprises spherical toner.

15. An image forming apparatus according to claim 3, wherein said toner comprises spherical toner.

16. An image forming apparatus according to claim 4, wherein said toner comprises spherical toner.

17. An image forming apparatus according to claim 5, wherein said toner comprises spherical toner.

18. An image forming apparatus according to claim 6, wherein said toner comprises spherical toner.

19. An image forming apparatus according to claim 7, wherein said toner comprises spherical toner.

20. An image forming apparatus according to claim 8, wherein said toner comprises spherical toner.

21. An image forming apparatus according to claim 9, wherein said toner comprises spherical toner.

22. An image forming apparatus according to claim 10, wherein said toner comprises spherical toner.

23. An image forming apparatus according to claim 11, wherein said toner comprises spherical toner.

* * * * *